US011225085B2

(12) United States Patent
Kuno et al.

(10) Patent No.: US 11,225,085 B2
(45) Date of Patent: *Jan. 18, 2022

(54) IMAGE PROCESSING DEVICE AND COMPUTER PROGRAM

(71) Applicant: BROTHER KOGYO KABUSHIKI KAISHA, Nagoya (JP)

(72) Inventors: Masashi Kuno, Obu (JP); Shota Morikawa, Nagoya (JP); Satoru Arakane, Nagoya (JP); Shin Hasegawa, Nagoya (JP); Yoshiharu Furuhata, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/794,523

(22) Filed: Feb. 19, 2020

(65) Prior Publication Data

US 2020/0262213 A1 Aug. 20, 2020

(30) Foreign Application Priority Data

Feb. 20, 2019 (JP) ..... JP2019-028926

(51) Int. Cl.
*B41J 2/205* (2006.01)
*B41J 2/045* (2006.01)

(52) U.S. Cl.
CPC ..... *B41J 2/2054* (2013.01); *B41J 2/04563* (2013.01)

(58) Field of Classification Search
CPC ..... B41J 2/2054
See application file for complete search history.

(56) References Cited

U.S. PATENT DOCUMENTS 10,807,380 B2 * 10/2020 Arakane ..... B41J 2/2132
2013/0083101 A1 * 4/2013 Maehira ..... G06K 15/107 347/9
2020/0016910 A1 * 1/2020 Arakane ..... B41J 19/145

FOREIGN PATENT DOCUMENTS

JP 2004-066550 A 3/2004

* cited by examiner

*Primary Examiner* — Sharon Polk
(74) *Attorney, Agent, or Firm* — Scully, Scott, Murphy & Presser, PC

(57) ABSTRACT

A control device is configured to: control a main scanning device and a sub-scanning device to print partial images by single partial printing in a first case where a specific condition is not satisfied, the specific condition indicating that ink supply to a printing head may be delayed in a partial printing and determined for each of the partial image, control the main scanning device and the sub-scanning device to print the partial images by a plurality of partial printings including a first partial printing and a second partial printing in a second case where the specific condition is satisfied, and determine a first area of the partial image to be printed by the first partial printing and a second area of the partial image to be printed by the second partial printing by using a pixel value information, in the second case.

12 Claims, 13 Drawing Sheets

FIG. 7

DETERMINATION THRESHOLD VALUE TABLE TT

| | | HEAD TEMPERATURE | | |
|---|---|---|---|---|
| | | LOW | MEDIUM | HIGH |
| CUMULATIVE-USED AMOUNT OF INK | SMALL | TH1 | TH4 | TH7 |
| | MEDIUM | TH2 | TH5 | TH8 |
| | LARGE | TH3 | TH6 | TH9 |

SECOND EMBODIMENT

THIRD EMBODIMENT

IMAGE PROCESSING DEVICE AND COMPUTER PROGRAM

CROSS-REFERENCE TO RELATED APPLICATIONS

This application is based upon and claims the benefit of priority from prior Japanese patent application No. 2019-028926, filed on Feb. 20, 2019, the entire contents of which are incorporated herein by reference.

TECHNICAL FIELD

The present disclosure relates to image processing for a printing execution unit configured to print an image by forming dots on a printing medium.

BACKGROUND ART

A printer configured to print an image by ejecting ink from nozzles of a printing head is known.

In the printer, for example, when a temperature of the ink is relatively low, a viscosity of the ink is increased, so that delay in ink supply from an accommodation part of the ink to the printing head is likely to occur. When the delay in ink supply occurs, an image quality is deteriorated due to thinning of a printed image, for example.

JP-A-2004-66550 discloses technology of, when the number of continuous ejections of dots counted in a band is larger than a threshold value corresponding to a temperature of the printing head, increasing the number of passes to print the band.

SUMMARY OF INVENTION

However, according to the aforementioned technology, it is not sufficiently considered how to divide the band when increasing the number of passes to print the band. For this reason, when the number of passes to print the band is increased, an image quality of an image to be printed may be deteriorated.

The present disclosure discloses technology capable of avoiding a situation where an image quality is deteriorated so as to avoid delay in ink supply, while avoiding the delay in ink supply.

The technology of the present disclosure may be implemented as following application examples.

APPLICATION EXAMPLE 1

A control device for a printing execution device includes:

a printing head that has a plurality of nozzles configured to eject ink;

an ink supply unit that is configured to supply the ink to the printing head;

a main scanning device that is configured to execute a main scanning of moving the printing head relative to a printing medium in a main scanning direction; and a sub-scanning device that is configured to execute a sub-scanning of moving the printing medium relative to the printing head in a sub-scanning direction intersecting with the main scanning direction.

The control device is configured to:

acquire image data including pixel value information, which is at least one of a pixel value and information for determining the pixel value; and cause the printing execution device to perform printing by performing a partial printing and causing the sub-scanning device to perform the sub-scanning multiple times, the partial printing being to cause the printing head to eject the ink to form dots on the printing medium while causing the main scanning device to execute the main scanning with the image data.

The control device is configured to control the main scanning device and the sub-scanning device to print partial images by single partial printing in a first case where a specific condition is not satisfied, the specific condition indicating that ink supply from the ink supply unit to the printing head may be delayed in the partial printing and determined for each of the partial images which corresponds to the partial printing and which is part of an image based on the image data, control the main scanning device and the sub-scanning device to print the partial images by a plurality of partial printings including a first partial printing and a second partial printing in a second case where the specific condition is satisfied, and determine a first area of the partial image to be printed by the first partial printing and a second area of the partial image to be printed by the second partial printing by using the pixel value information included in the image data, in the second case.

According to the above configuration, in the second case in which the specific condition is satisfied, the partial image is printed by the plurality of partial printings including the first partial printing and the second partial printing. Therefore, it is possible to avoid the delay in ink supply, as compared to a case in which the partial image is printed by single partial printing. Also, in the second case, the image data is analyzed to determine the first area, which is to be printed by the first partial printing, and the second area, which is to be printed by the second partial printing, of the partial image. For this reason, it is possible to reduce a case where a boundary between the first area and the second area is noticeable, as compared to a case in which the first area and the second area are configured as preset areas. Therefore, while avoiding the delay in ink supply, it is possible to avoid a situation where an image quality is deteriorated so as to avoid the delay in ink supply.

In the meantime, the technology of the present disclosure may be implemented in a variety of forms, such as a printing apparatus, a control method of the printing execution unit, a printing method, a computer program for implementing functions of the apparatus and method, a recording medium having the computer program recorded thereon, and the like.

BRIEF DESCRIPTION OF DRAWINGS

FIG. 7 depicts an example of a determination threshold value table TT.

DESCRIPTION OF EMBODIMENTS

A. First Embodiment

A-1: Configuration of Printer 200

Figure 1:
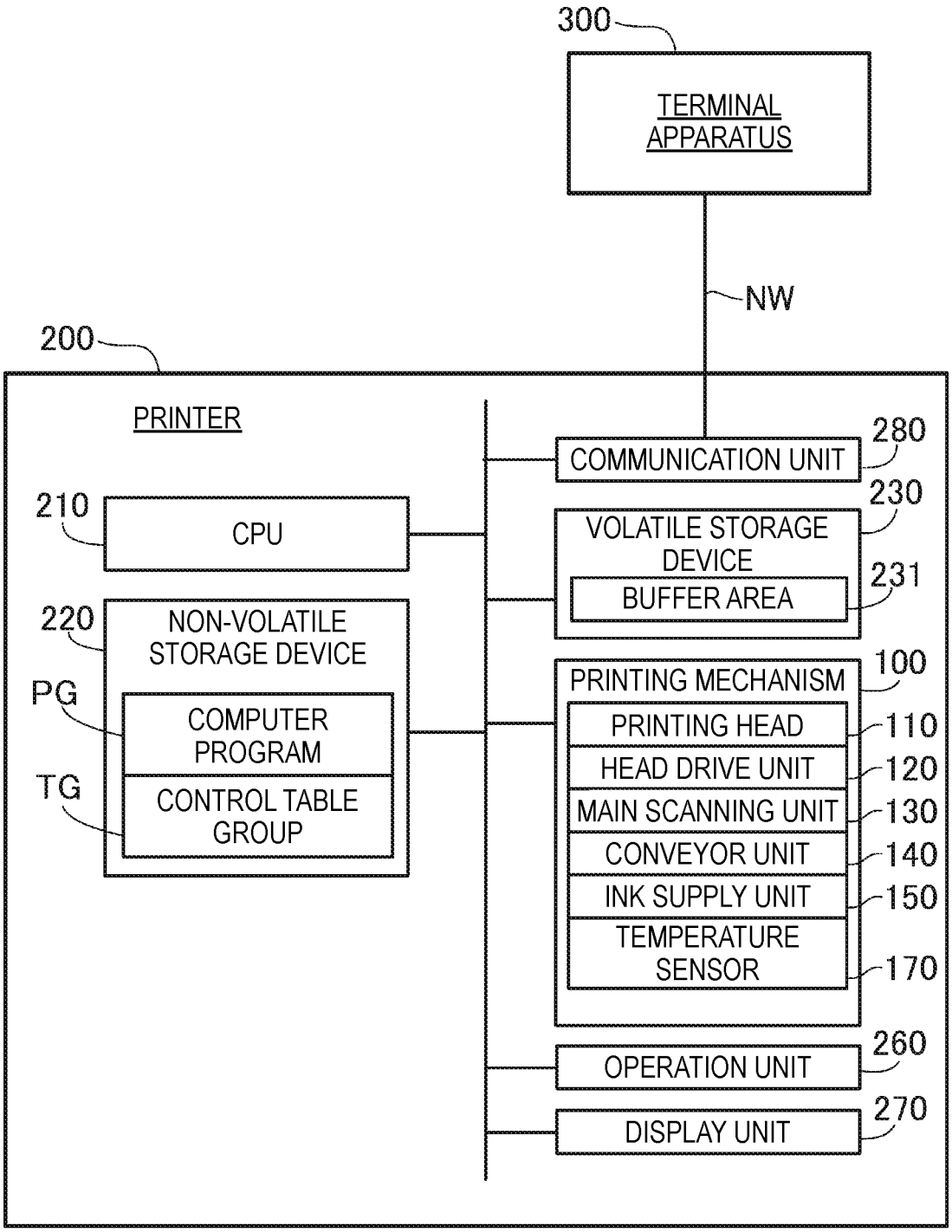
FIG. 1 is a block diagram depicting a configuration of a printer 200 of an embodiment.

Hereinbelow, an embodiment is described. FIG. 1 is a block diagram depicting a configuration of a printer 200 of an embodiment.

The printer 200 includes, for example, a printing mechanism 100, a CPU 210 as a controller of the printer 200, a non-volatile storage device 220 such as a hard disk drive, a volatile storage device 230 such as a RAM, an operation unit 260 such as buttons and a touch panel for acquiring a user's operation, a display unit 270 such as a liquid crystal monitor, and a communication unit 280. The communication unit 280 includes a wired or wireless interface for connection to a network NW. The printer 200 is communicatively connected to an external apparatus, for example, a terminal apparatus 300 via the communication unit 280.

The volatile storage device 230 provides a buffer area 231 for temporarily storing therein a variety of intermediate data that are generated when the CPU 210 performs processing. In the non-volatile storage device 220, a computer program PG and a control table group TG are stored. In the first embodiment, the computer program PG is a control program for controlling the printer 200. The computer program PG and the control table group TG may be provided while being stored in the non-volatile storage device 220 upon shipment of the printer 200. Instead of this configuration, the computer program PG and the control table group TG may be downloaded from a server or may be provided while being stored in a DVD-ROM and the like. The CPU 210 is configured to execute the computer program PG, thereby executing image processing to be described later, for example. Thereby, the CPU 210 controls the printing mechanism 100 to print an image on a printing medium (for example, sheet). The control table group TG includes a table that is to be used in image processing, for example, a determination threshold value table TT, which will be described later.

The printing mechanism 100 is configured to form dots on a sheet M by using inks (ink droplets) of cyan (C), magenta (M), yellow (Y) and black (K), thereby performing color printing. The printing mechanism 100 includes a printing head 110, a head drive unit 120, a main scanning unit 130, a conveyor unit 140, an ink supply unit 150 and a temperature sensor 170.

Figure 2:
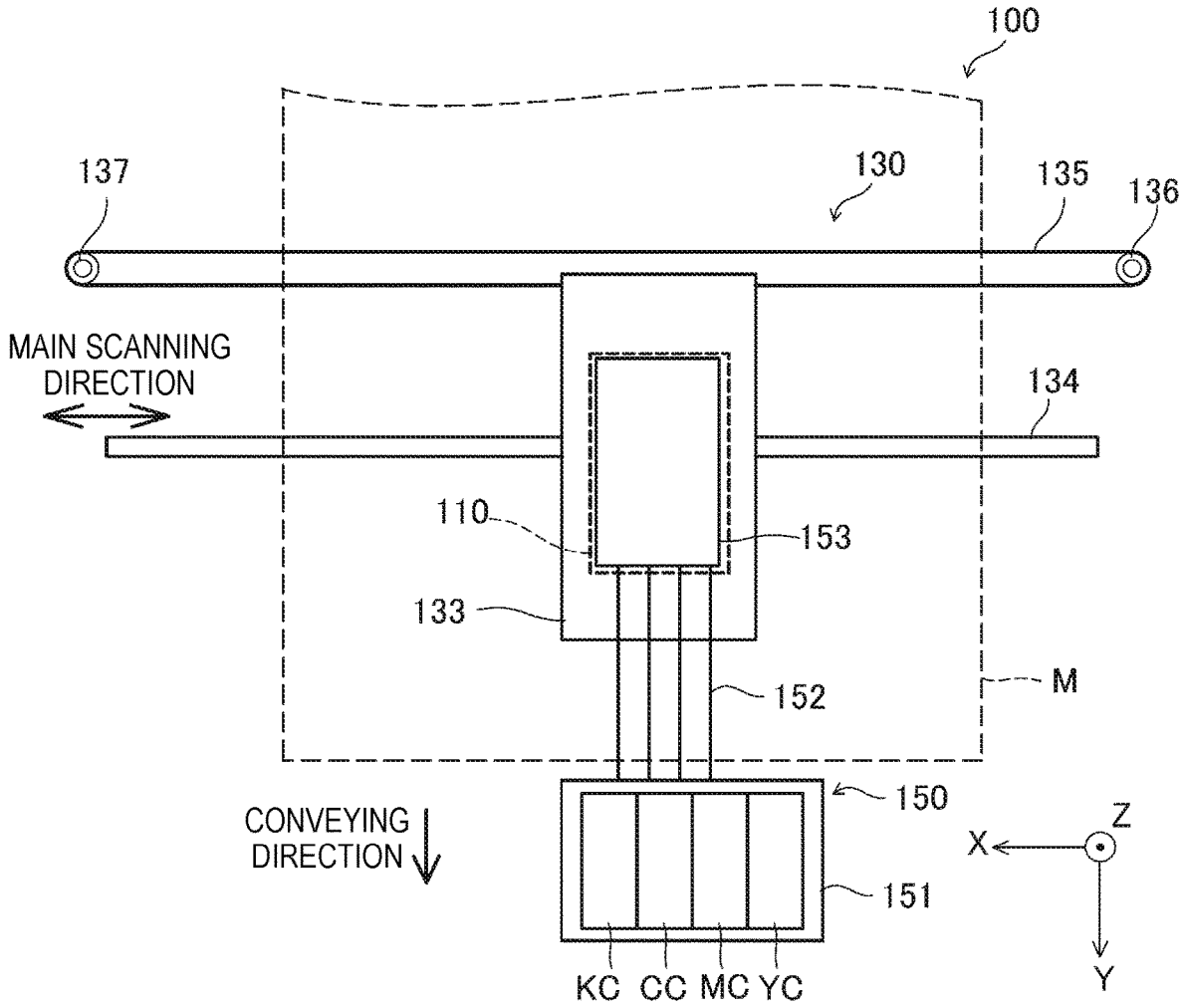
FIG. 2 depicts a schematic configuration of a printing mechanism 100.

FIG. 2 depicts a schematic configuration of the printing mechanism 100. As shown in FIG. 2, the main scanning unit 130 includes a carriage 133, a slide shaft 134, a belt 135, and a plurality of pulleys 136, 137. The carriage 133 is configured to mount thereon the printing head 110. The slide shaft 134 is configured to hold the carriage 133 to be reciprocally moveable in a main scanning direction (X-axis direction, in FIG. 2). The belt 135 is wound on the pulleys 136, 137, and a part thereof is fixed to the carriage 133. The pulley 136 is rotated by power of a main scanning motor (not shown). When the main scanning motor rotates the pulley 136, the carriage 133 moves along the slide shaft 134. Thereby, a main scanning of reciprocally moving the printing head 110 relative to the sheet M in the main scanning direction is implemented.

The conveyor unit 140 is configured to convey the sheet M in a conveying direction (+Y direction, in FIG. 2) while holding the sheet M. Hereinbelow, an upstream side (−Y side) in the conveying direction is simply referred to as 'upstream side', and a downstream side (+Y side) in the conveying direction is simply referred to as 'downstream side'. Although not specifically shown, the conveyor unit 140 includes a pair of upstream rollers configured to hold the sheet M on a further upstream side than the printing head 110, a pair of downstream rollers configured to hold the sheet M on a further downstream side than the printing head 110, and a motor. The conveyor unit 140 is configured to convey the sheet M by driving the rollers with power of the motor.

The ink supply unit 150 is configured to supply ink to the printing head 110. The ink supply unit 150 includes a cartridge mounting unit 151, tubes 152, and a buffer tank 153. A plurality of ink cartridges KC, CC, MC, YC in which inks are accommodated is detachably mounted to the cartridge mounting unit 151, and the inks are supplied from the ink cartridges. The buffer tank 153 is arranged above the printing head 110 mounted to the carriage 133, and is configured to temporarily accommodate therein each ink of CMYK to be supplied to the printing head 110. The tube 152 is a flexible tube configured to interconnect the cartridge mounting unit 151 and the buffer tank 153 and becoming a flow path of the ink. The ink in each ink cartridge is supplied to the printing head 110 through the cartridge mounting unit 151, the tube 152 and the buffer tank 153. The buffer tank 153 is provided with a filter (not shown) for removing foreign matters mixed in the ink.

Figure 3:
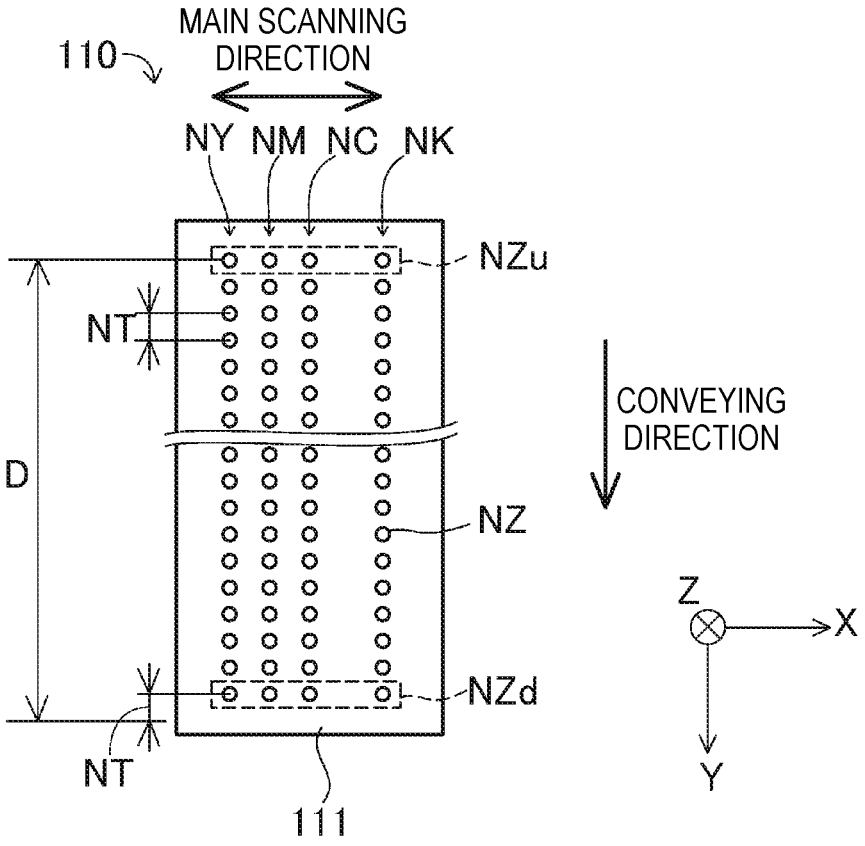
FIG. 3 depicts a configuration of a printing head 110, as seen from −Z side.

FIG. 3 depicts a configuration of the printing head 110, as seen from −Z side. As shown in FIG. 3, a nozzle formation surface 111 of the printing head 110 is a surface facing the sheet M to be conveyed by the conveyor unit 140. The nozzle formation surface 111 is formed with a plurality of nozzle rows consisting of a plurality of nozzles NZ, i.e., nozzle rows NC, NM, NY, NK for ejecting the respective inks of C, M, Y and K. Each nozzle row includes a plurality of nozzles NZ. The plurality of nozzles NZ has positions different from each other in the conveying direction (+Y direction), and is aligned with predetermined nozzle intervals NT in the conveying direction. The nozzle interval NT is a length in the conveying direction between two nozzles NZ, which are adjacent to each other in the conveying direction, of the plurality of nozzles NZ. A nozzle NZ, which is located on the most upstream side (−Y side), of the nozzles configuring the nozzle row is referred to as the most upstream nozzle NZu. Also, a nozzle NZ, which is located on the most downstream side (+Y side), of the nozzles is referred to as the most downstream nozzle NZd. A length obtained by adding the nozzle interval NT to a length in the conveying direction from the most upstream nozzle NZu to the most downstream nozzle NZd is referred to as 'nozzle length D'.

Positions of the nozzle rows NC, NM, NY, NK in the main scanning direction are different, and positions thereof in a sub-scanning direction overlap each other. For example, in the example of FIG. 3, the nozzle row NM is arranged in the +X direction of the nozzle row NY for ejecting the yellow (Y) ink.

Each nozzle NZ is connected to the buffer tank 153 through an ink flow path (not shown) formed in the printing head 110. Actuators (not shown, piezoelectric elements, in the first embodiment) for ejecting the inks along the respective ink flow paths in the printing head 110 are provided.

The head drive unit 120 (FIG. 1) is configured to drive each actuator in the printing head 110, according to printing data to be supplied from the CPU 210 during the main scanning by the main scanning unit 130. Thereby, the inks are ejected from the nozzles NZ of the printing head 110 onto the sheet M being conveyed by the conveyor unit 140, so that dots are formed. The configuration of the head drive unit 120 will be described later. The head drive unit 120 is configured to form a plurality of sizes of dots on the sheet M by changing a drive voltage to be supplied to the actuators. For example, the head drive unit 120 is configured to form three types of dots "small", "medium" and "large".

The temperature sensor 170 is a well-known temperature sensor including a temperature measurement resistance member and the like, and is provided in the vicinity of the printing head 110 of the printer 200. The temperature sensor 170 is configured to output a signal indicative of a temperature of the printing head 110 of the printer 200.

A-2. Outline of Printing

The CPU 210 is configured to print a printed image on the sheet M by alternately executing more than once partial printing of causing the printing head 110 to eject the inks to form dots on the sheet M while causing the main scanning unit 130 to perform the main scanning, and a sub-scanning (conveyance of the sheet M) by the conveyor unit 140.

Figure 4:
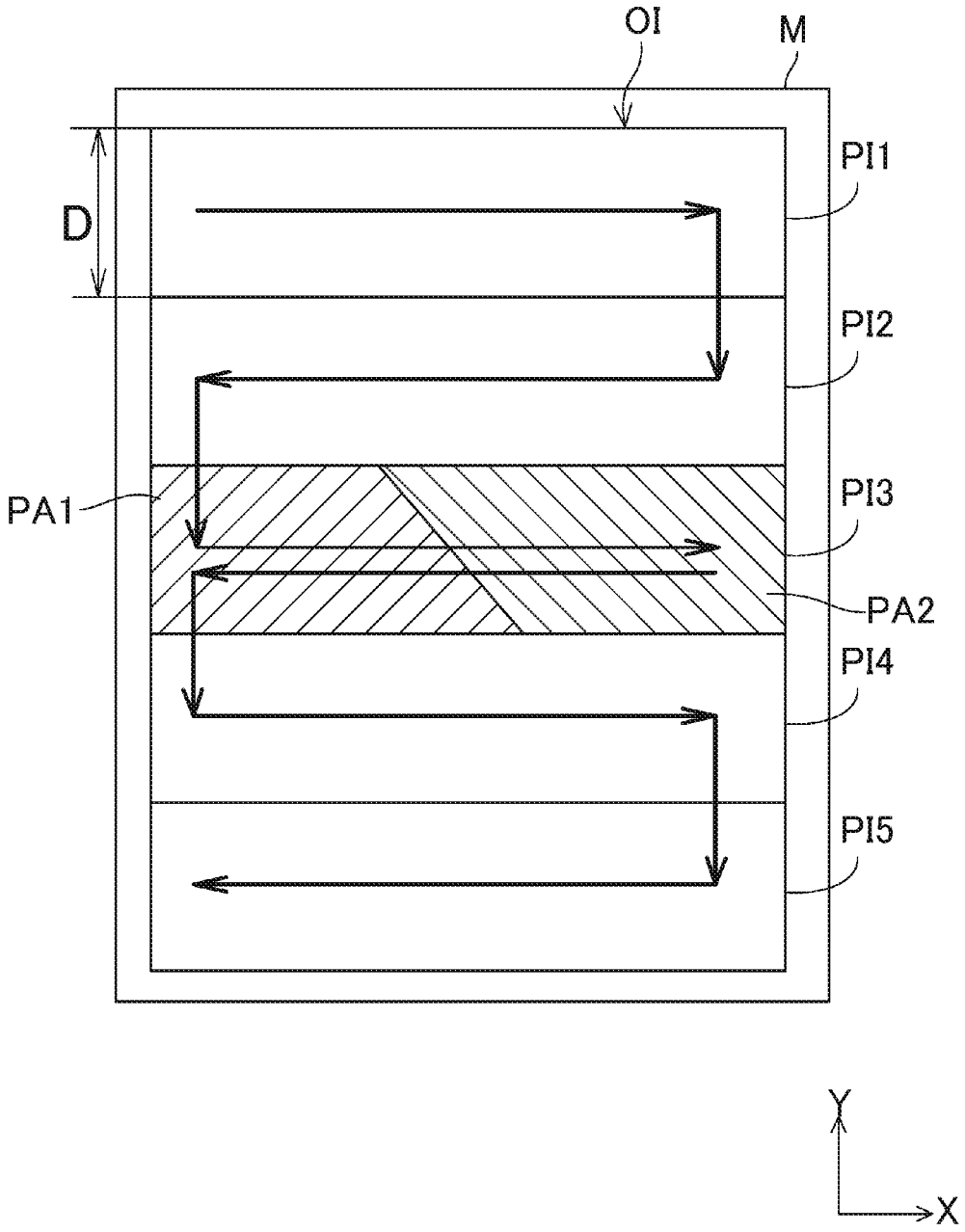
FIG. 4 illustrates operations of the printing mechanism 100.

FIG. 4 illustrates operations of the printing mechanism 100. In FIG. 4, a printed image OI to be printed on the sheet M is shown. The printed image OI includes a plurality of partial images PI1 to PI5. Each partial image is, in principle, an image to be printed by single partial printing. Although described in detail later, one partial image may be printed by two partial printings. A printing direction of the partial printing is one of a forward direction and a backward direction. That is, the partial printing is one of forward printing of forming dots while performing the main scanning in the forward direction (+X direction in FIG. 4) and backward printing of forming dots while performing the main scanning in the backward direction (−X direction in FIG. 4).

In the partial image of FIG. 4, at least one arrow in the +X direction or the −X direction is shown. The partial images PI1 and PI4 denoted with one arrow in the +X direction are forward partial images to be printed by one forward printing. The partial images PI2 and PI5 denoted with one arrow in the −X direction are backward partial images to be printed by one backward printing. The hatched partial image PI3 is denoted with two arrows in the +X direction and the −X direction. The partial image PI3 is a reciprocal partial image to be printed by two partial printings having first partial printing (for example, single forward printing) and second partial printing (for example, single backward printing). The partial image PI3 includes a first area PA1 that is to be printed by the first partial printing and a second area PA2 that is to be printed by the second partial printing. A method of determining the first area PA1 and the second area PA2 will be described later.

As shown in FIG. 4, the printing of the first embodiment is bidirectional printing in which the forward printing and the backward printing are alternately executed. The bidirectional printing shorten printing time, as compared to unidirectional printing in which only the forward printing is to be repeatedly executed, for example. In the unidirectional printing, since the forward printing is again executed after the forward printing, it is necessary to move the printing head 110 in the backward direction without executing the partial printing. However, it is not necessary to perform such operation in the bidirectional printing.

In FIG. 4, the arrow in the −Y direction facing from one partial image (for example, the partial image PI1) toward another partial image (for example, the partial image PI2) adjacent thereto in the −Y direction corresponds to the conveyance (sub-scanning) of the sheet M. That is, in FIG. 4, the arrow in the −Y direction indicates that the sheet M is conveyed and the printing head 110 is thus moved relative to the sheet M shown in FIG. 4 in the −Y direction. As shown in FIG. 4, the printing of the first embodiment is in principle so-called one pass printing, and a length of each partial image in the conveying direction and a single conveying amount of the sheet M are the nozzle length D. In the meantime, like the partial image PI3, in a specific case, a partial image may be printed by two partial printings (which will be described in detail later).

Here, when the ink is ejected from the nozzles NZ during the printing, the ink is reduced in the buffer tank 153 (FIG. 2) by an ejected amount of the ink, so that a negative pressure is generated in the buffer tank 153. By the negative pressure, the ink is supplied from the ink cartridge to the buffer tank 153 through the cartridge mounting unit 151 and the tube 152. When a large amount of ink is ejected from the plurality of nozzles NZ in a short time for printing, the ink supply to the buffer tank 153 may be delayed. When the delay in ink supply occurs, even though the actuator is actuated, a case where the ink is not ejected from the nozzles NZ or a case where a smaller amount of ink than expected is ejected occurs. When such malfunction occurs, a color is thinned and an image quality is thus degraded in the printed image OI.

The delay in ink supply is likely to occur when flowability of the ink is lowered. For example, the lower a temperature (hereinafter, also referred to as 'head temperature Th') of the printing head 110 of the printer 200 (the printing mechanism 100) is, the more the delay in ink supply is likely to occur. The reason is that as the head temperature Th is lowered, a viscosity of the ink is increased, resulting in a decrease in flowability of the ink. Here, a cumulative-used amount TA of ink is an index value indicative of a cumulative-used amount of a specific ink (any one of C, M, Y and K) up to now since the manufacturing of the printer 200. The larger the cumulative-used amount TA of ink is, the more the delay of specific ink supply is likely to occur. The reason is that as the cumulative-used amount TA of ink increases, an accumulation amount of foreign matters in a filter for removing the foreign matters in the ink increases, resulting in an increase in flow path resistance of the ink and a decrease in flowability of the ink. Also, the more a used amount of the specific ink to be used for partial image printing in the single partial printing is, the more the delay of specific ink supply is likely to occur. The reason is that since the specific ink is used in a short time, the specific ink supply cannot keep up with the used amount.

In image processing to be described below, a scheme for avoiding the delay in ink supply is made. Specifically, when printing a specific partial image (the partial image PI3, in the example of FIG. 4) in which a specific condition, which indicates that the delay in ink supply is likely to occur, is satisfied, the specific partial image is printed by the two partial printings, as described above. Thereby, as compared to a case in which the specific partial image is printed by single partial printing, it is possible to reduce an amount of ink to be used per single partial printing. Therefore, since it is possible to prevent a large amount of ink from being used when printing the specific partial image, it is possible to avoid the delay in ink supply when printing the specific partial image.

A-3. Image Processing

Figure 5:
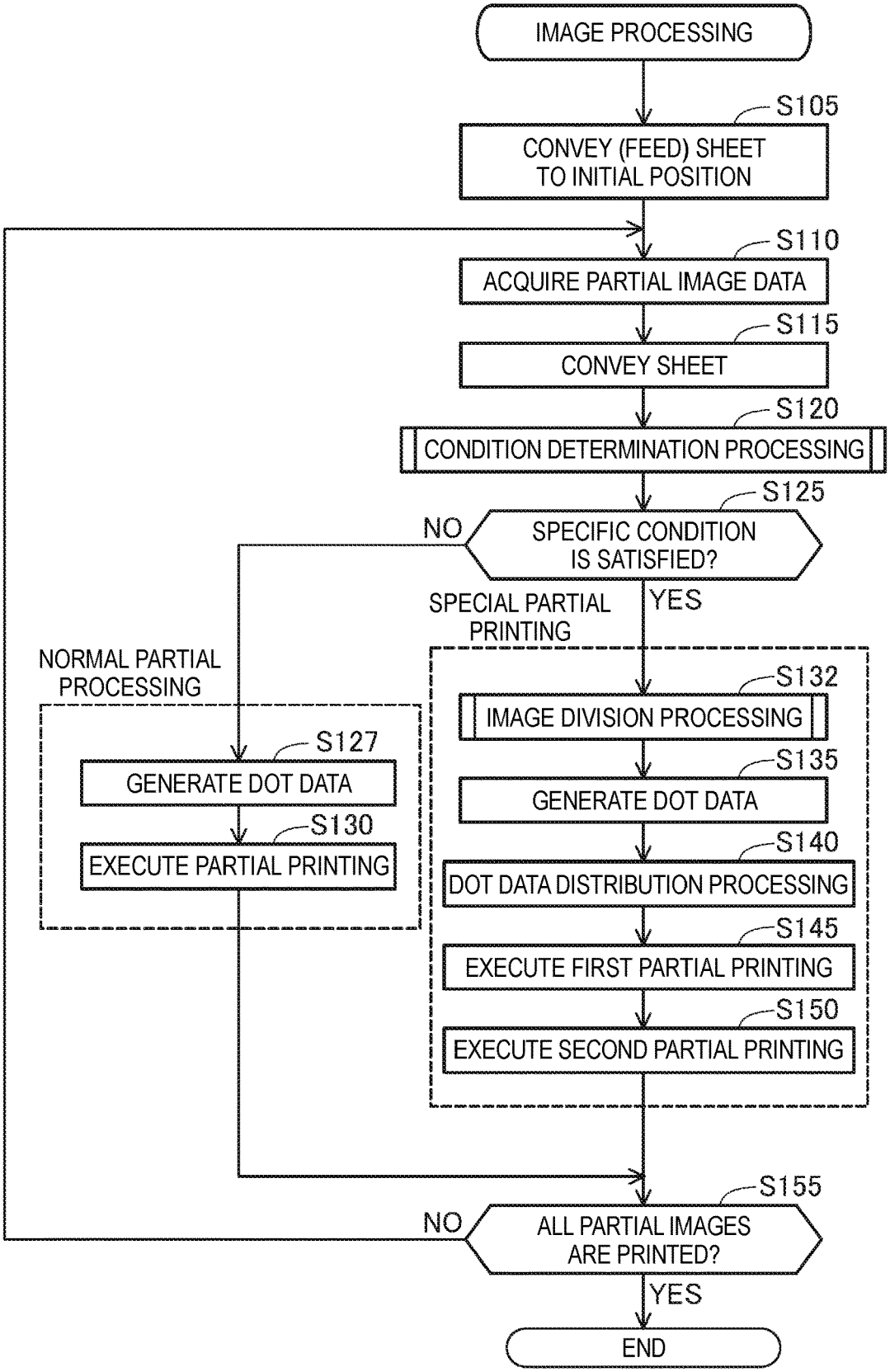
FIG. 5 is a flowchart of image processing of a first embodiment.

FIG. 5 is a flowchart of image processing of the first embodiment. When the CPU 210 of the printer 200 receives a printing instruction from the terminal apparatus 300 (FIG. 1), for example, the CPU 210 starts the image processing. Instead of this configuration, the CPU 210 may start the image processing when a printing instruction is acquired from a user through the operation unit 260. The printing instruction includes a designation of image data indicative of an image to be printed.

In S105, the CPU 210 controls the conveyor unit 140 to convey (feed) one sheet M from a print tray (not shown) to a predetermined initial position.

In S110, the CPU 210 acquires partial image data, which corresponds to a partial image to be printed by the single partial printing, as notice partial image data, and stores the same in the buffer area 331. For example, the CPU 210 acquires the notice partial image data by receiving the notice partial image data from the terminal apparatus 300. The notice partial image data is RGB image data. The RGB image data includes a plurality of pixel values, and each of the plurality of pixel values indicates a pixel color with color values of RGB color coordinate system (also referred to as 'RGB values'). RGB values of one pixel include values of three color components of red (R), green (G) and blue (B) (hereinbelow, also referred to as 'R value, G value and B value'), for example. In the first embodiment, the number of gradations of each component value is 256 gradations.

In the meantime, the partial image corresponding to the notice partial image data is also referred to as 'notice partial image'. The partial printing for printing the notice partial image is also referred to as 'notice partial printing'.

In S115, the CPU 210 controls the conveyor unit 140 to convey the sheet M so that a position of the printing head 110 relative to the sheet M in the conveying direction is to be a position in which the notice partial image is to be printed. For example, when the second partial printing and thereafter is the notice partial printing, the sheet M is conveyed by the nozzle length D, as can be seen from FIG. 4.

In S120, the CPU 210 executes condition determination processing. The condition determination processing is processing of determining whether a specific condition, which indicates that the ink supply from the ink supply unit 150 to the printing head 110 in the notice partial printing may be delayed, is satisfied.

Figure 6:
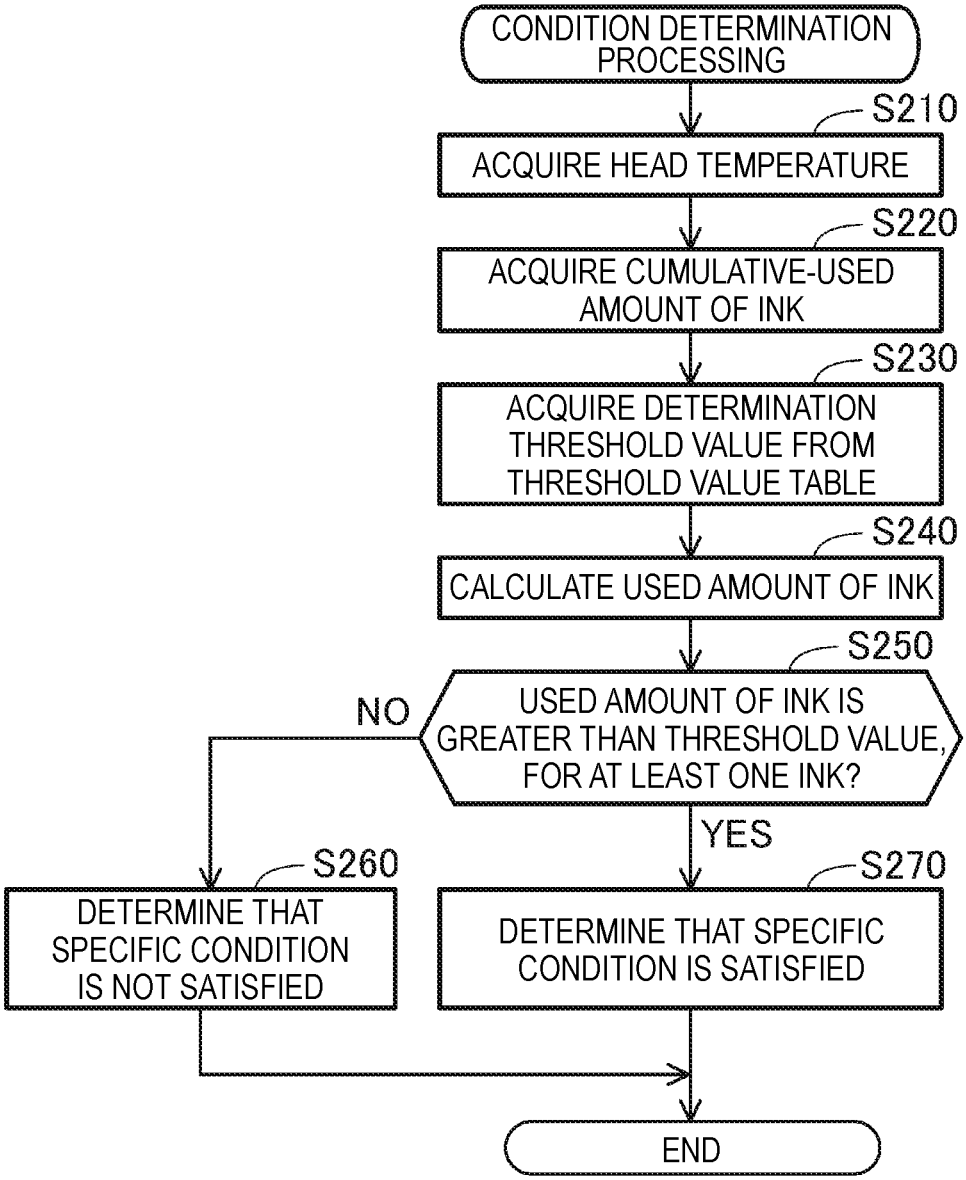
FIG. 6 is a flowchart of condition determination processing.

FIG. 6 is a flowchart of the condition determination processing. FIG. 7 depicts an example of a determination threshold value table TT. The determination threshold value table TT is included in the control table group TG (FIG. 1). When the condition determination processing is initiated, in S210, the CPU 210 acquires a head temperature Th of the printing head 110 of the printer 200, based on a signal from the temperature sensor 170.

In S220, the CPU 210 acquires the cumulative-used amount TA of each ink to be used for printing from the non-volatile storage device 220. The cumulative-used amount TA of ink is recorded for each ink of CMYK in a predetermined area of the non-volatile storage device 220. The CPU 210 calculates a used amount of ink of each color on the basis of the number of dots formed by the printing and updates the cumulative-used amount TA of ink whenever executing the printing, for example. In S220, for example, in the case of monochrome printing, the cumulative-used amount TA of black (K) ink is acquired, and in the case of color printing, the cumulative-used amount TA of each ink of CMYK is acquired.

In S230, the CPU 210 acquires, based on the head temperature Th and the cumulative-used amount TA of ink, a determination threshold value JT corresponding to each ink to be used for printing, from the determination threshold value table TT. In the determination threshold value table TT of FIG. 7, determination threshold values JT are recorded in correspondence to combinations of the head temperature Th and the cumulative-used amount TA of ink. For example, in the example of FIG. 7, when the acquired head temperature Th is within a preset range "medium" and the cumulative-used amount TA of ink acquired for specific ink is within a preset range "large", 'TH6' is acquired as the determination threshold value JT corresponding to the specific ink. In the case of the monochrome printing, the determination threshold value JT corresponding to the black (K) ink is acquired, and in the case of the color printing, the determination threshold value JT corresponding to each ink of CMYK is acquired.

In the determination threshold value table TT, the larger the cumulative-used amount TA of ink is, the smaller the determination threshold value JT is. Also, the lower the head temperature Th is, the smaller the determination threshold value JT is.

In S240, the CPU 210 calculates a used amount IU of ink of each ink of CMYK to be used for printing of the notice partial image by using the notice partial image data. The used amount IU of ink is calculated as follows. For example, the control table group TG of the non-volatile storage device 220 includes a look-up table (not shown) in which RGB values and used amounts of inks of CMYK are associated with each other. The CPU 210 refers to the look-up table to specify used amounts of inks for each pixel of the notice partial image data, and calculates a sum value of the used amounts of inks for each pixel, as the used amount IU of ink.

In S250, the CPU 210 determines whether the used amount IU of ink is greater than the determination threshold value JT, for at least one ink to be used for printing. When it is determined that the used amount IU of ink is greater than the determination threshold value JT, a large amount of ink is ejected in a short time, so that the delay in ink supply may occur. For this reason, when it is determined for at least one ink to be used for printing that the used amount IU of ink is greater than the determination threshold value JT (S250: YES), the CPU 210 determines in S270 that the specific condition is satisfied. When it is determined for all inks to be used for printing that the used amount IU of ink is equal to or smaller than the determination threshold value JT (S250: NO), the CPU 210 determines in S260 that the specific condition is not satisfied. When the determination as to whether the specific condition is satisfied is made, the condition determination processing is over.

When the condition determination processing is over, it is determined in S125 of FIG. 5 whether it has been determined in the condition determination processing that the specific condition is satisfied. When it is determined that the specific condition is not satisfied (S125: NO), the CPU 210 executes normal partial printing by using the notice partial image data, in S127 and S130.

Specifically, in S127, the CPU 210 generates dot data by using the notice partial image data. Specifically, the CPU 210 executes color conversion processing on the notice partial image data to convert values of a plurality of pixels included in the notice partial image data from RGB values into CMYK values. The CMYK values are color values including a plurality of component values (component values of C, M, Y and K) corresponding to a plurality of color materials to be used for printing. The color conversion processing is executed with reference to a profile (not shown) in which correspondence relation between RGB values and CMYK values is defined. The CPU 210 executes halftone processing on the notice partial image data (CMYK image data) after the color conversion processing. Thereby, dot data indicative of a formation state of dot is formed for each color material to be used for printing and for each pixel. The formation state of dot may take two states of "dot" and "no dot" or four states of "large dot", "medium dot", "small dot" and "no dot". The halftone processing is executed according to a dithering method or an error diffusion method.

In S130, the CPU 210 supplies the generated dot data to the printing mechanism 100 to cause the printing mechanism 100 to execute the partial printing. In this way, in the normal partial printing, the notice partial image is printed by single partial printing. When the previous partial printing is the forward printing, the backward printing is executed, and when the previous partial printing is the backward printing, the forward printing is executed. Thereby, the notice partial image is printed on the sheet M.

When it is determined that the specific condition is satisfied (S125: YES), the CPU 210 executes special partial printing in S132 to S150. In the special partial printing, the notice partial image is printed on the sheet by two partial printings, i.e., the first partial printing and the second partial printing.

In S132, the CPU 210 executes image division processing. The image division processing is processing of dividing the notice partial image into a first area PA1 to be printed by the first partial printing and a second area PA1 to be printed by the second partial printing (FIG. 4). The image division processing will be described later.

In S135, the CPU 210 generates dot data by using the notice partial image data, like in S127.

In S140, the CPU 210 executes dot data distribution processing. The dot data distribution processing is processing of generating first dot data for printing an image in the first area PA1 and second dot data for printing an image in the second area PA2 by using the dot data of the notice partial image.

In S145, the CPU 210 supplies the generated first dot data to the printing mechanism 100 to cause the printing mechanism 100 to execute the first partial printing. When the previous partial printing is the forward printing, the backward printing is executed as the first partial printing, and when the previous partial printing is the backward printing, the forward printing is executed as the first partial printing. Thereby, an image in the first area PA1 of the notice partial image is printed on the sheet M.

In S150, the CPU 210 supplies the generated second dot data to the printing mechanism 100 to cause the printing mechanism 100 to execute the second partial printing. When the first partial printing is the forward printing, the backward printing is executed as the second partial printing, and when the first partial printing is the backward printing, the forward printing is executed as the second partial printing. Thereby, an image in the second area PA2 of the notice partial image is printed on the sheet M.

In S155, the CPU 210 determines whether all partial images of an image to be printed have been printed. When it is determined that all the partial images have been printed (S155: YES), the CPU 210 ends the image processing. When it is determined that there is a partial image not printed yet (S155: NO), the CPU 210 returns to S110.

A-4. Image Division Processing

Figure 8:
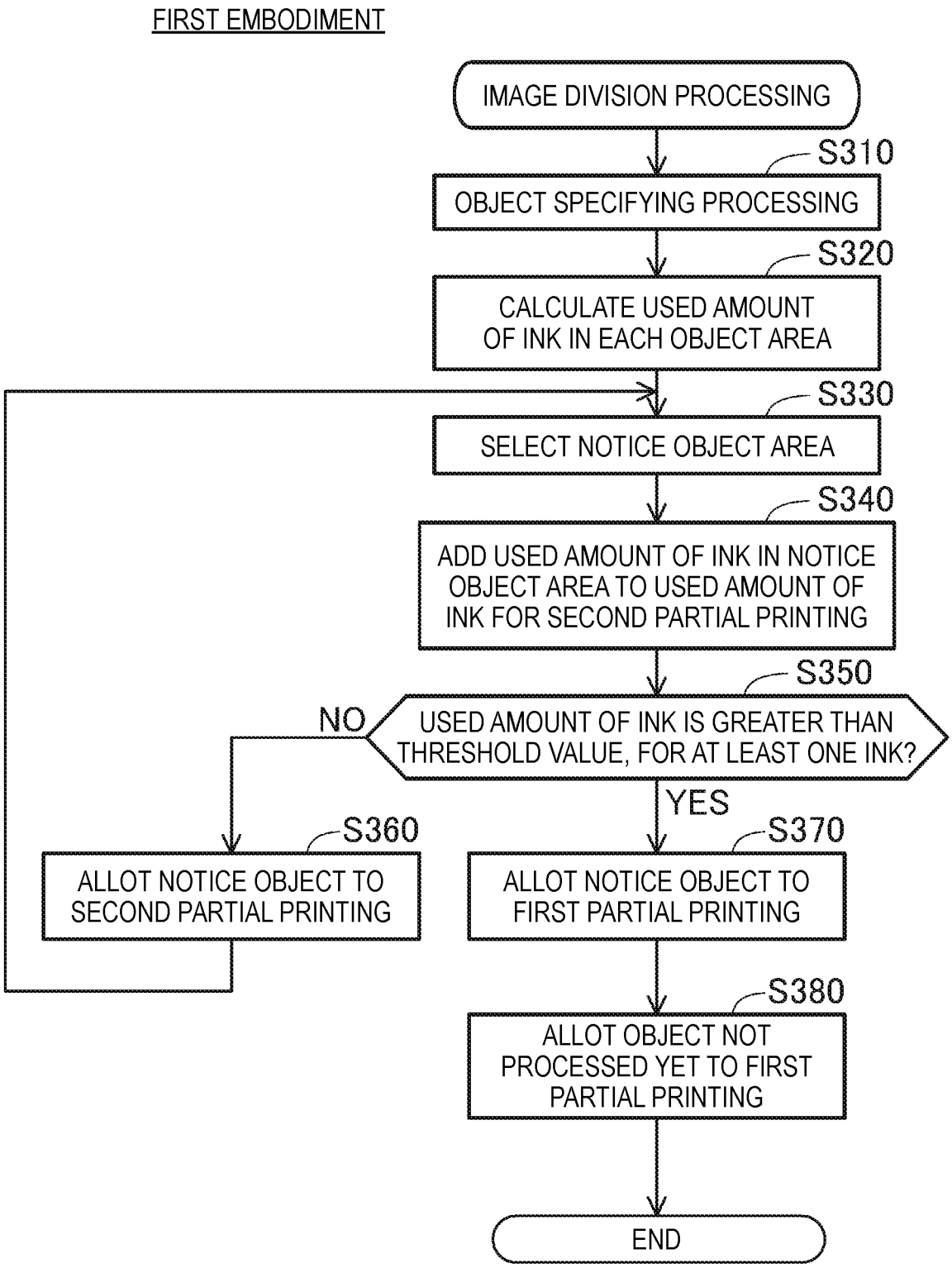
FIG. 8 is a flowchart of image division processing of the first embodiment.
Figure 9:
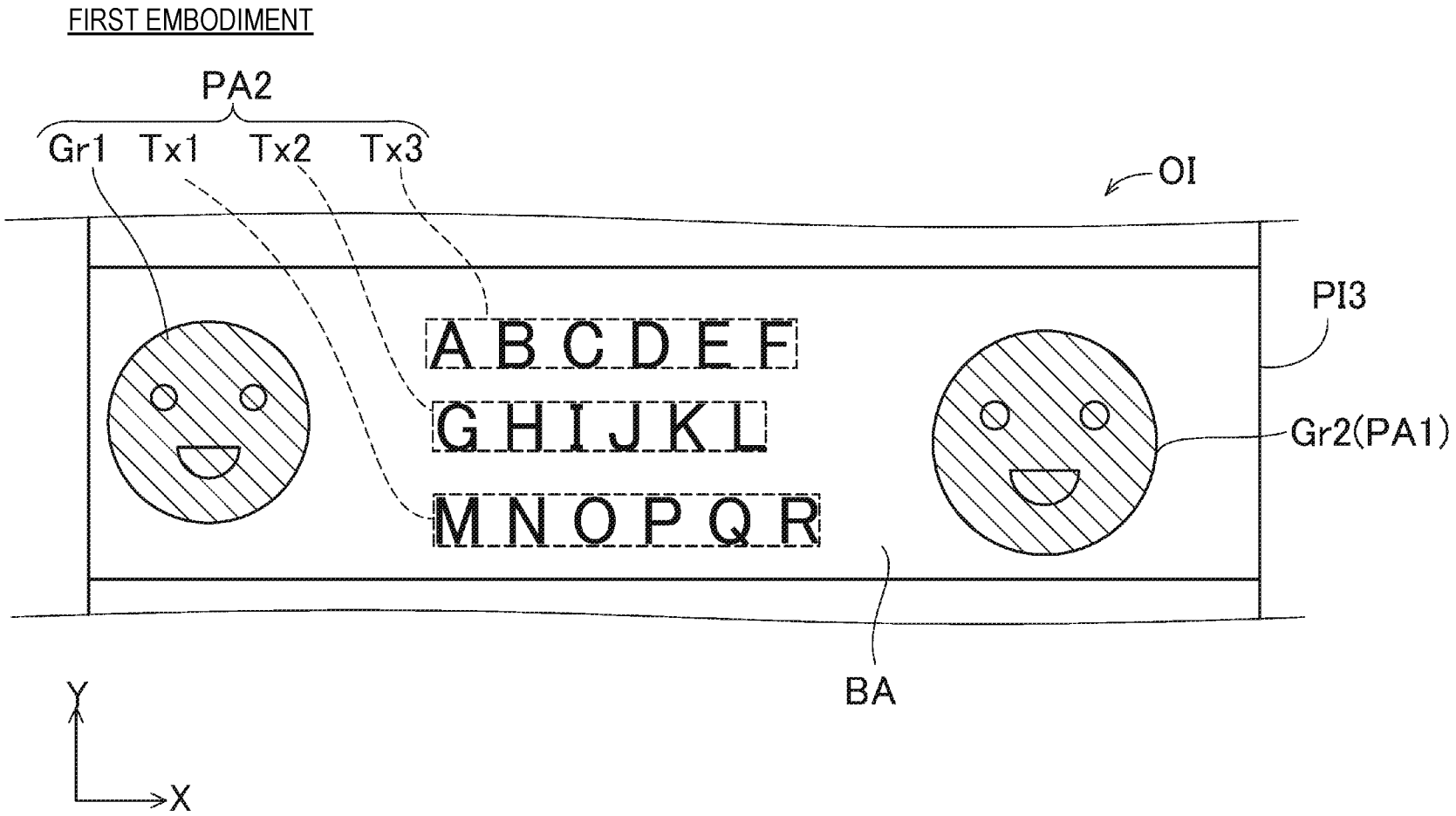
FIG. 9 illustrates the image division processing of the first embodiment.

The image division processing in S132 of FIG. 5 is described. FIG. 8 is a flowchart of the image division processing of the first embodiment. FIG. 9 illustrates the image division processing of the first embodiment. FIG. 9 depicts an example of the partial image PI3 of the printed image OI (FIG. 1).

In S310, the CPU 210 executes object specifying processing by using the notice partial image data. For example, the CPU 210 binarizes the notice partial image by classifying the same into white background pixels (i.e., pixels corresponding to an area in which no dot is formed upon printing) and object pixels of colors different from white (i.e., pixels corresponding to an area in which dots are formed upon printing). The CPU 210 executes labeling processing to specify object areas each having a plurality of continuous object pixels. The CPU 210 integrates object areas, which are relatively close to each other, into one object area. For example, in a case in which the partial image PI3 of FIG. 9 is a notice partial image, five object areas of three character areas Tx1 to Tx3 and two graphic areas Gr1 and Gr2 are specified. The object areas are separate from each other. That is, each of the object areas is continuous to a background area BA having background pixels and is not continuous to the other object areas.

In S320, the CPU 210 calculates a used amount IUo of ink of the respective inks of CMYK in each object area. The used amount IUo of ink is an index value relating to an amount of ink to be used for printing of an image in an object area. For example, the CPU 210 specifies used amounts of inks for each pixel in the object area by referring to the look-up table in which the RGB values and the used amounts of inks of CMYK are associated with each other, thereby calculating a summed value of the used amounts of inks for each pixel, as the used amount IUo of ink.

In S330, the CPU 210 selects one notice object area from one or more object areas specified in the notice partial image. For example, in a case in which the partial image PI3 of FIG. 9 is a notice partial image, one notice object area is sequentially selected from three character areas Tx1 to Tx3 and two graphic areas Gr1 and Gr2.

In S340, the CPU 210 adds the used amount IUo of ink in the notice object area to a used amount Vt of ink for second partial printing. The used amount Vt of ink is calculated for each ink of CMYK.

In S350, the CPU 210 determines whether the used amount Vt of ink for the second partial printing is greater than a determination threshold value JT, for at least one ink. As used herein, the determination threshold value JT is the same as the determination threshold value JT used in S250 of FIG. 6.

When it is determined for all the inks that the used amount Vt of ink for the second partial printing is equal to or less than the determination threshold value JT (S350: NO), the CPU 210 allots the notice object area to the second partial printing, in S360. That is, in this case, the notice object area is classified as an area belonging to the second area PA2 that is to be printed by the second partial printing. After S360, the CPU 210 returns to S330, and selects an object area not processed yet, as a notice object area.

When it is determined for at least one ink that the used amount Vt of ink for the second partial printing is greater than the determination threshold value JT (S350: YES), the CPU 210 allots the notice object area to the first partial printing, in S370. That is, in this case, the notice object area and all object areas not processed yet are classified as areas belonging to the first area PA1 that is to be printed by the first partial printing. After S380, the image division processing is over.

In this way, the object areas are allotted to the first area PA1 and the second area PA2 so that the used amount IUo of ink for the second partial printing is to increase as much as possible within a range not exceeding the determination threshold value JT. In the first embodiment, the determination threshold value JT is set to a value sufficiently greater than a half of a maximum used amount of ink when printing one partial image. For this reason, in the first embodiment, the used amount IUo of ink for the second partial printing is greater than the used amount IUo of ink for the first partial printing.

In a case in which the partial image PI3 of FIG. 9 is a notice partial image, it is assumed that the graphic area Gr1, the character areas Tx1 to Tx3 and the graphic area Gr2 are sequentially processed in corresponding order. Also, it is assumed that, when the graphic area Gr2 is a notice object area, the used amount Vt of ink for the second partial printing becomes greater than the determination threshold value JT. In this case, the first area PA1 is determined as the graphic area Gr2, and the second area PA2 is determined as an overall of the three character areas Tx1 to Tx3 and one graphic area Gr1.

According to the first embodiment as described above, in a first case in which the specific condition, which indicates that the ink supply may be delayed during the partial printing, is not satisfied (NO in S125 in FIG. 5), the notice partial image is printed by single partial printing (S127 and S130 in FIG. 5), and in a second case in which the specific condition is satisfied (YES in S125 in FIG. 5), the notice partial image is printed by the two partial printings including the first partial printing and the second partial printing (S132 to S150 in FIG. 5). In the second case, the CPU 210 determines the first area PA1 to be printed by the first partial printing and the second area PA2 to be printed by the second partial printing of the notice partial image by using the values of pixels included in the notice partial image data (S132 in FIG. 5 and FIG. 8). In this way, in the second case, since the notice partial image is printed by the two partial printings, it is possible to avoid the delay in ink supply, as compared to a case in which the partial image is printed by single partial printing. Also, in the second case, since the first area PA1 and the second area PA2 are determined using the values of pixels included in the notice partial image data, it is possible to reduce case where a boundary between the first area PA1 and the second area PA2 is noticeable, as compared to a case in which the first area PA1 and the second area PA2 are configured as preset areas. Therefore, while avoiding the delay in ink supply, it is possible to avoid the situation where the image quality is deteriorated so as to avoid the delay in ink supply. A case in which the first area PA1 and the second area PA2 are configured as preset areas, for example, an upstream half of the notice partial image with respect to the conveying direction is set as the first area PA1 and a downstream half is set as the second area PA2 is considered. In this case, the boundary between the first area PA1 and the second area PA2 may exist in one object area (for example, the graphic area Gr1 in FIG. 9), depending on contents of the notice partial image. In this case, when seen from an observer, a noticeable stripe may occur at the boundary between the first area PA1 and the second area PA2. According to the first embodiment, it is possible to avoid such malfunction, thereby avoiding the deterioration in image quality.

For example, according to the first embodiment, the CPU 210 determines a first area PA1 and a second area PA2 so that the first area PA1 and the second area PA2 are respectively to be continuous to the background area BA (also referred to as 'third area'), in which no dot is formed in any of the first partial printing and the second partial printing, and are not to be continuous to each other (S310 to S380 in FIG. 8). For example, in the example of FIG. 9, the first area PA1 (graphic area Gr2) is continuous to only the background area BA and is not continuous to the second area PA2 (three character areas Tx1 to Tx3 and graphic area Gr1). That is, the first area PA1 and the second area PA2 are separated from each other by the background area BA. Therefore, for example, the boundary between the first area PA1 and the second area PA2 is not located in the graphic area Gr1 or the graphic area Gr2. Accordingly, it is possible to effectively reduce the case where the boundary between the first area PA1 and the second area PA2 is noticeable.

The CPU 210 specifies the plurality of objects (for example, the characters and graphics expressed in the character areas Tx1 to Tx3 and the graphic areas Gr1 and Gr2 in FIG. 9) in the notice partial image by using the values of pixels included in the notice partial image data (S310 in FIG. 8). The CPU 210 determines, as the first area PA1, an area including a first object (for example, a graphic expressed in the graphic area Gr2) of a plurality of objects, and determines, as the second area PA2, an area including a second object (for example, a character expressed in the character area Tx1) (S330 to S380 in FIG. 8). As a result, since it is possible to avoid a situation where the boundary between the first area PA1 and the second area PA2 is located in the first object or the second object, it is possible to effectively reduce the case where the boundary between the first area PA1 and the second area PA2 is noticeable.

Also, according to the first embodiment, the CPU 210 calculates the used amount IUo of ink for each of the plurality of object areas in the notice partial image by using the values of pixels included in the notice partial image data (S320 in FIG. 8). The CPU 210 classifies the plurality of object areas into an area belonging to the first area PA1 and an area belonging to the second area PA2 by using the used amount IUo of ink, thereby determining the first area PA1 and the second area PA2 (S330 to S380 in FIG. 8). As a result, it is possible to appropriately determine the first area PA1 and the second area PA2 by using the used amount IUo of ink, which is an index value relating to the amount of ink. For example, it is possible to determine the first area PA1 and the second area PA2 so that amounts of inks to be used for printing of the first area PA1 and the second area PA2 are not to exceed the determination threshold value JT.

Also, according to the first embodiment, the CPU 210 determines the first area PA1 and the second area PA2 so that the amount of ink to be used for printing of the second area PA2 is greater than the amount of ink to be used for printing of the first area PAL In other words, the first area PA1 and the second area PA2 are determined so that the amount of ink to be used for the second partial printing, which is to be executed later, is greater than the amount of ink to be used for the first partial printing, which is to be executed first. As a result, it is possible to further avoid the deterioration in image quality of the printed image.

More specifically, when printing the same area by the two partial printings, the ink attached by the first partial printing permeates into the sheet M, so that the sheet M may be partially extended and deformed. For example, the sheet M may be deformed to approach the printing head 110. In this state, when the second partial printing is executed, the sheet M may contact the nozzle formation surface 111 of the printing head 110. In this case, the sheet M may be smudged or the nozzles NZ on the nozzle formation surface 111 may be damaged. Also, a distance between the nozzle formation surface 111 and the sheet M becomes shorter than expected, so that a spotting position of ink ejected in the second partial printing becomes different from an expected position. As a result, an image quality of an image to be printed may be deteriorated. For this reason, it is preferably to avoid the deformation of the sheet M after the first partial printing by reducing the amount of ink ejected in the first partial printing as much as possible. According to the first embodiment, since the amount of ink to be used for the second partial printing, which is to be executed later, is greater than the amount of ink to be used for the first partial printing, which is to be executed first, it is possible to avoid the above malfunctions.

According to the first configuration, each of the plurality of object areas is determined as any one of the first area PA1 and the second area PA2 so that the amount of ink to be used for printing of the second area PA2 is greater than the amount of ink to be used for printing of the first area PA1 and is smaller than a specific upper limit amount (an amount corresponding to the determination threshold value JT) (S350 in FIG. 8). As a result, while avoiding the delay in ink supply, it is possible to appropriately avoid the malfunction due to the deformation of the printing medium during the second partial printing.

B. Second Embodiment

Figure 10:
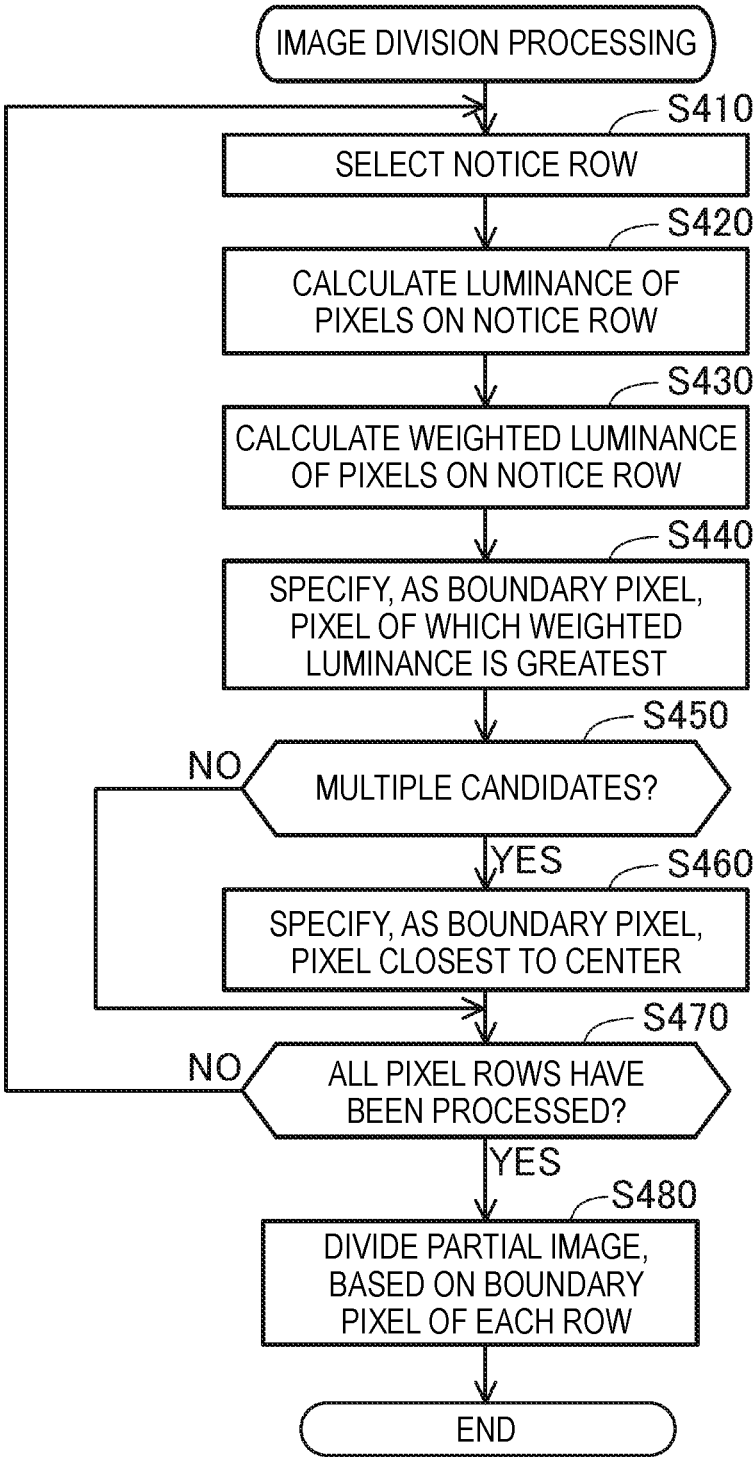
FIG. 10 is a flowchart of image division processing of a second embodiment.
Figure 11:
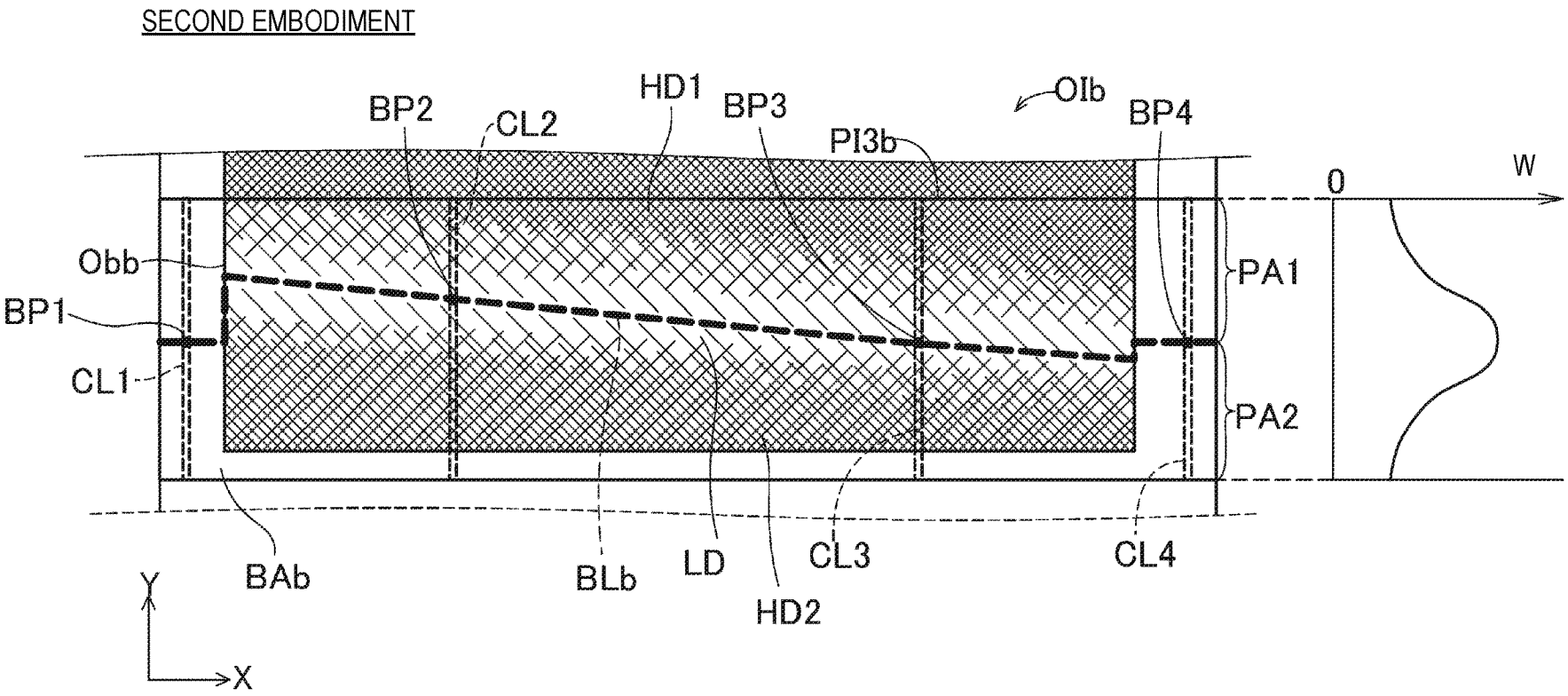
FIG. 11 illustrates the image division processing of the second embodiment.

In a second embodiment, image division processing different from the image division processing (FIG. 8) of the first embodiment is executed. The image processing of the second embodiment except the image division processing is similar to that of the first embodiment. FIG. 10 is a flowchart of image division processing of the second embodiment. FIG. 11 illustrates the image division processing of the second embodiment. In FIG. 11, an example of a partial image PI3*b* of a printed image OIb is shown. Since the partial image PI3*b* satisfies the specific condition, like the partial image PI3 (FIG. 4) of the first embodiment, it is printed by the two partial printings. The partial image PI3*b* includes an object Obb including a relatively high (thick) density area and a relatively low (thin) density area, like a gradation.

In S140 of FIG. 10, the CPU 210 selects one notice row from a plurality of pixel rows in the notice partial image. In FIG. 11, four pixel rows CL1 to CL4 of the partial image PI3*b* are exemplified. Each of the pixel rows is a row consisting of a plurality of pixels aligned in a predetermined direction (the Y direction (FIG. 11) corresponding to the conveying direction, in the second embodiment). Each of the pixel rows extends along the predetermined direction from one end to the other end of the notice partial image in the predetermined direction. For example, in a case in which the partial image PI3*b* in FIG. 11 is a notice partial image, a plurality of pixel rows including the pixel rows CL1 to CL4 is sequentially selected one by one from an upstream end (a left end in FIG. 11) with respect to the X direction to a downstream end (a right end in FIG. 11) with respect to the X direction.

In S420, the CPU 420 calculates a luminance V of each of the plurality of pixels on the notice row. The luminance V is calculated based on an equation (V=(0.0298912×R)+(0.586611×G)+(0.114478×B)) by using the RGB values (R, G, B). The luminance V is a value having negative correlativity with the density because it becomes smaller as the density increases and becomes larger as the density decreases.

In S430, the CPU 210 calculates a weighted luminance Vw of each of the plurality of pixels on the notice row. The weighted luminance Vw is a value obtained by multiplying a weight W by the luminance V. The weight W is a value that is set according to a position in a direction of a pixel row (Y direction in FIG. 11), and is shown on the right side in FIG. 7. The weight W is greatest at the center of the notice partial image in the Y direction, and becomes smaller away from the center in the Y direction. The weight W is smallest at both ends (upper and lower ends in FIG. 11) of the notice partial image in the Y direction.

In S440, the CPU 210 specifies, as a boundary pixel BP, a pixel having the maximum weighted luminance Vw from the plurality of pixels on the notice row. Since the pixel rows CL1 and CL4 are located in a white background area Bab, the luminance V of all pixels on the pixel rows CL1 and CL4 in FIG. 11 is greatest. For this reason, the positions on the pixel rows CL1 and CL4, in which the weighted luminance Vw is greatest, are the central positions in the Y direction. Therefore, in a case in which the notice row is the pixel rows CL1 and CL4, pixels located at the center in the Y direction are specified as boundary pixels BP1 and BP4. The pixel rows CL2 and CL3 are located in the object Obb. Positions on the pixel rows CL2 and CL3, in which the weighted luminance Vw is greatest, are portions in which the density of the object Obb is relatively low. For this reason, in a case in which the notice row is the pixel rows CL2 and CL3, pixels located at the portions in which the density is relatively low are specified as boundary pixels BP2 and BP3.

In S450, the CPU 210 determines whether a candidate for the boundary pixel BP is plural, i.e., whether there is a plurality of pixels of which the weighted luminance Vw is greatest. When it is determined that there is a plurality of candidates for the boundary pixel BP (S450: YES), the CPU 210 specifies, as the boundary pixel BP, a pixel closest to the center in the Y direction of the plurality of candidates, in S460. When it is determined that a candidate for the boundary pixel BP is not plural (S450: NO), the CPU 210 skips over S460.

In S470, the CPU 210 determines whether all the pixel rows in the notice partial image have been processed as the notice row. When it is determined that all the pixel rows have been processed (S470: YES), the CPU 210 proceeds to S480. When it is determined that there is a pixel row not processed yet (S470: NO), the CPU 210 returns to S410.

In S480, the CPU 210 divides the notice partial image, based on the boundary pixel BP of each pixel row, thereby determining the first area PA1 and the second area PA2. Specifically, the CPU 210 allots pixels, which are located downstream (upper side in FIG. 11) of the boundary pixel BP with respect to the Y direction, to the first partial printing, and allows the boundary pixel BP and pixels, which are located upstream (lower side in FIG. 11) of the boundary pixel BP with respect to the Y direction, to the second partial printing. As a result, an area upstream of a boundary line BLb, which is obtained by connecting the boundary pixels BP on the respective pixel rows, with respect to the Y direction is determined as the first area PA1, and an area (including pixels on the boundary line BLb) downstream of the boundary line BLb with respect to the Y direction is determined as the second area PA2. When the first area PA1 and the second area PA2 are determined, the division processing is over.

According to the second embodiment as described above, as shown in FIG. 11, the first area PA1 and the second area PA2 are determined so that the notice partial image is to be divided by a low density portion LD having a relatively low density (i.e., a portion having a relatively high luminance V) of the notice partial image (for example, the partial image PI3*b*). In the example of FIG. 11, high density portions HD1 and HD2 of which a density is higher than the low density portion LD are located upstream and downstream of the low density portion LD with respect to the Y direction. As shown in FIG. 11, the partial image PI3*b* includes the high density portion HD1, the low density portion LD located in the −Y direction (lower direction in FIG. 11) with respect to the high density portion HD1, and the high density portion HD2 located in the −Y direction with respect to the low density portion LD. In this case, the CPU 210 determines an area including the high density portion HD1, as the first area PA1, and determines an area including the high density portion HD2, as the second area PA2. As a result, since a boundary between the first area PA1 and the second area PA2 is located in the low density portion LD having a density lower than those of the high density portion HD1 and the high density portion HD2 (FIG. 11), it is possible to effectively reduce the case where the boundary between the first area PA1 and the second area PA2 is noticeable. The reason is that when the boundary between the first area PA1 and the second area PA2 is located in the low density portion, the boundary is more difficult to be noticeable, as compared to a case in which the boundary is located in the high density portion.

Also, according to the second embodiment, the CPU 210 calculates the weighted luminance Vw of the plurality of pixels by using the luminance V as an index value indicative of a density of each of the plurality of pixels aligned in the Y direction and the weights W corresponding to positions in the Y direction (S420 and S430 in FIG. 10). Then, the CPU 210 specifies, as the boundary pixel BP configuring the low density portion LD, the pixel, which has the maximum weighted luminance Vw, of the plurality of areas, i.e., the pixel of which the density indicated by the weighted luminance Vw is lowest (S440 in FIG. 10). The CPU 210 determines the first area PA1 and the second area PA2 by using the specifying result of the boundary pixels BP, i.e., the specifying result of the low density portion LD (S480 in FIG. 10). As shown in FIG. 11, the weight W is set so that, when the central portion and both ends in the Y direction have the same density, the weighted luminance Vw of the pixel located at the central portion indicates the density lower than the weighted luminance Vw of the pixels located at both end portions in the specific direction. As a result, when dividing the notice partial image, in a case in which there are pixels having about the same degree of densities in a plurality of positions in the Y direction, the boundary pixel BP is specified in the vicinity of the center in the Y direction. As a result, it is possible to appropriately divide the notice partial image into the first area PA1 and the second area PA2. For example, if the notice partial image is divided at an end portion in the Y direction, one of the first area PA1 and the second area PA2 may become excessively large and the other may become excessively small. In this case, there is a possibility that the used amount of ink in one of the first area PA1 and the second area PA2 will excessively increase (for example, exceed the determination threshold value JT). In this case, when printing one of the first area PA1 and the second area PA2, there is a possibility that the delay in ink supply will occur. According to the second embodiment, it is possible to avoid the problem.

More specifically, a weight W corresponding to a central portion in a specific direction is greater than weights W corresponding to both end portions in the specific direction (FIG. 11). As a result, in a case in which the index value relating to the density is luminance or brightness having negative correlativity with the density, like the second embodiment, it is possible to specify the appropriate boundary pixel BP.

C. Third Embodiment

Figure 12:
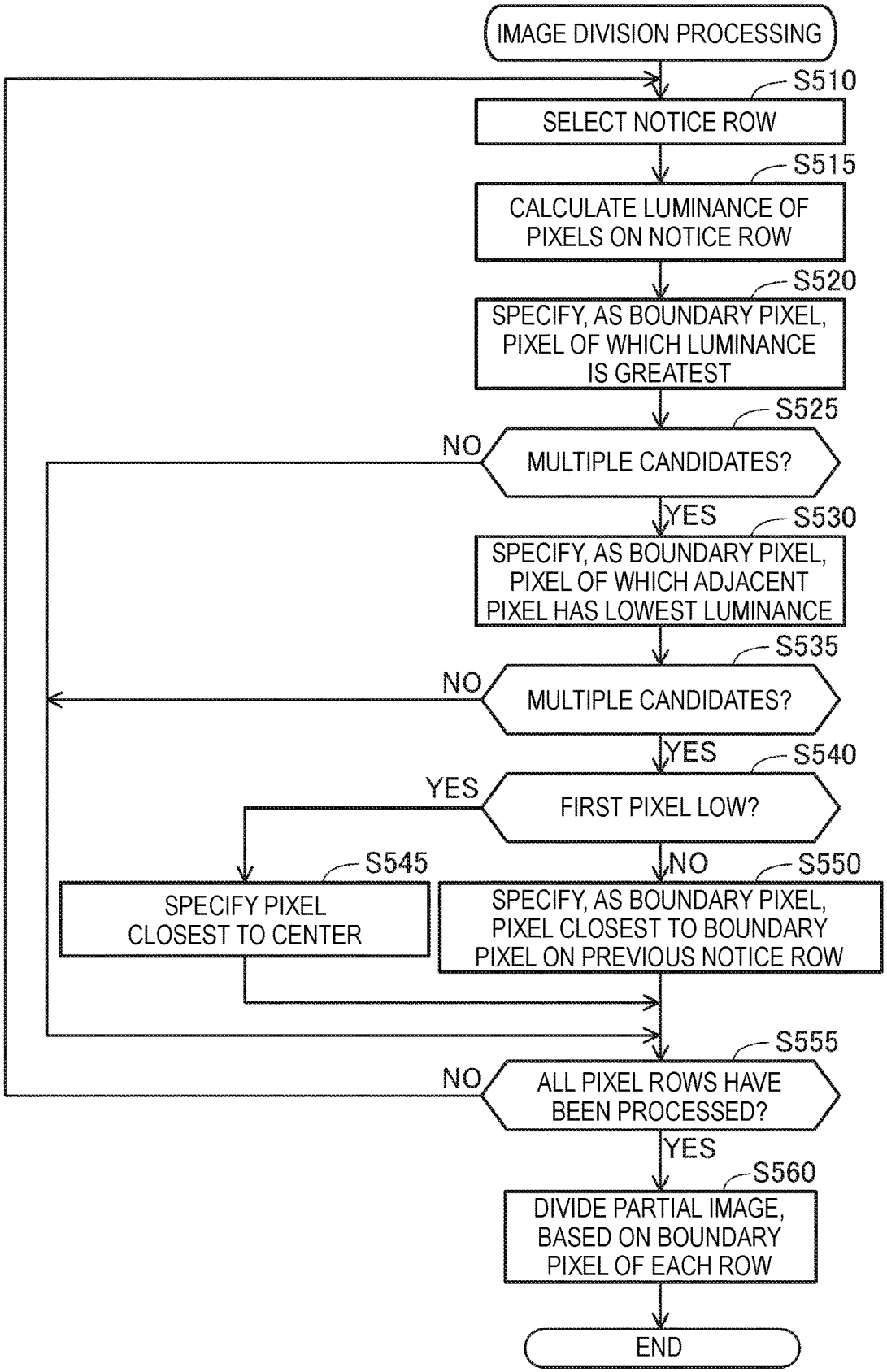
FIG. 12 is a flowchart of image division processing of a third embodiment.
Figure 13:
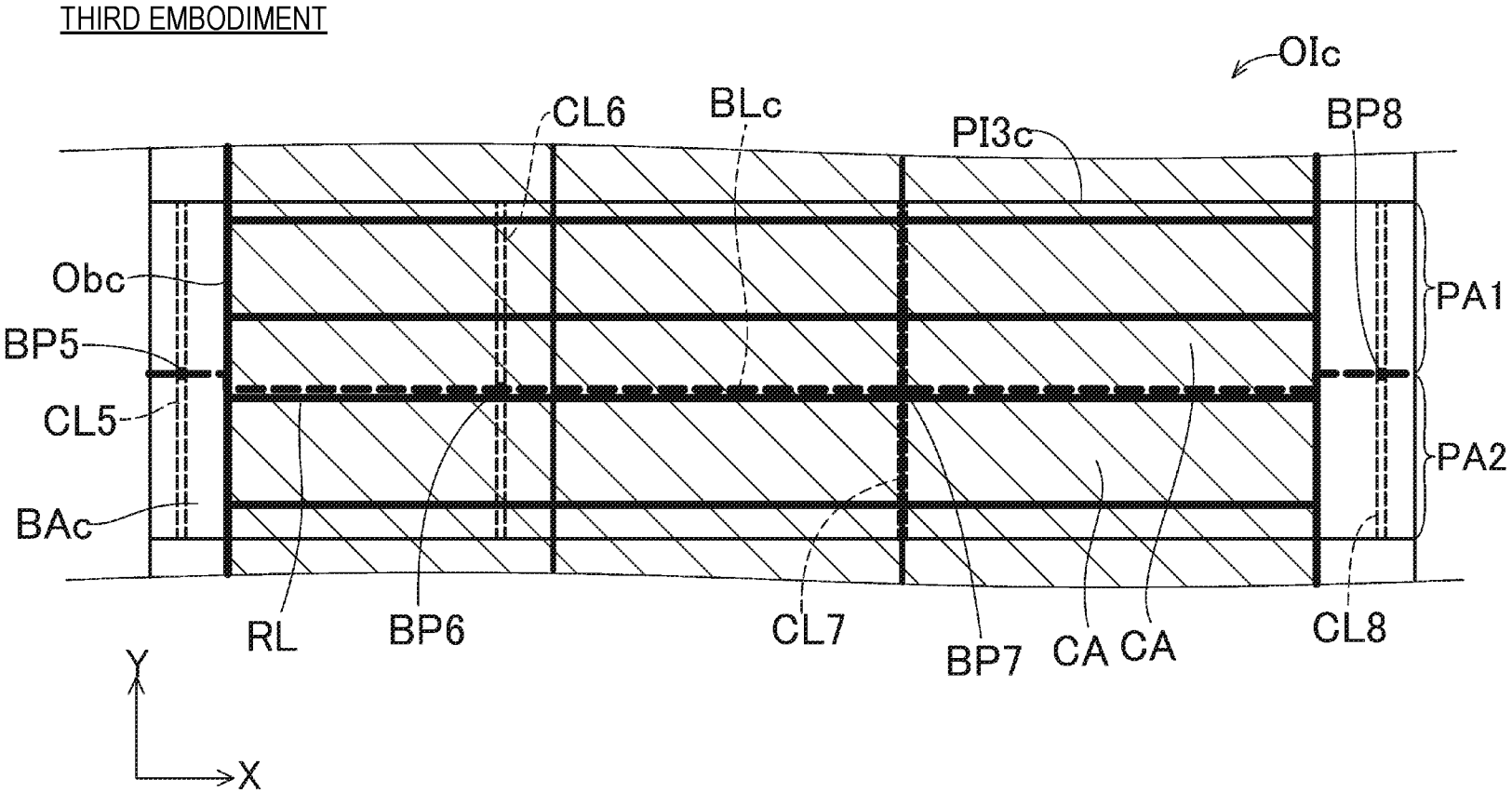
FIG. 13 illustrates the image division processing of the third embodiment.

In a third embodiment, image division processing different from the image division processing (FIG. 8) of the first embodiment is executed. The image processing of the third embodiment except the image division processing is similar to that of the first embodiment. FIG. 12 is a flowchart of image division processing of the third embodiment. FIG. 13 illustrates the image division processing of the third embodiment. In FIG. 13, an example of a partial image PI3*c* of a printed image OIc is shown. Since the partial image PI3*c* satisfies the specific condition, like the partial image PI3 (FIG. 4) of the first embodiment, it is printed by the two partial printings. The partial image PI3*c* includes, as an object, a table Obc including ruled lines RL and a plurality of solid rectangular areas CA demarcated by the ruled lines RL, for example.

In S510 of FIG. 12, the CPU 210 selects one notice row from a plurality of pixel rows in the notice partial image. In FIG. 13, four pixel rows CL5 to CL8 of the partial image PI3*c* are exemplified. Each of the pixel rows is a row consisting of a plurality of pixels aligned in the Y direction, like the pixel rows CL1 to CL4 in FIG. 11. For example, in a case in which the partial image PI3*c* in FIG. 13 is a notice partial image, a plurality of pixel rows including the pixel rows CL5 to CL8 is sequentially selected one by one from an upstream end (a left end in FIG. 13) with respect to the X direction to a downstream end (a right end in FIG. 13) with respect to the X direction.

In S515, the CPU 210 calculates luminance V of each of the plurality of pixels on the notice row. The method of calculating the luminance V is similar to the method of calculating the luminance V in FIG. 10 of the second embodiment. In S520, the CPU 210 specifies, as the boundary pixel BP, a pixel of which luminance V is greatest from the plurality of pixels on the notice row.

In S525, the CPU 210 determines whether a candidate for the boundary pixel BP is plural, i.e., whether there is a plurality of pixels of which the luminance Vw is greatest. When it is determined that a candidate for the boundary pixel BP is not plural (S525: NO), the CPU 210 proceeds to S555. When it is determined that a candidate for the boundary pixel BP is plural (S525: YES), the CPU 210 specifies, as the boundary pixel BP, a pixel, of which an adjacent pixel has the lowest luminance, of the plurality of candidates, in S530.

In S535, the CPU 210 determines whether a candidate for the boundary pixel BP is plural, i.e., whether there is a plurality of pixels of which luminance V is greatest and an adjacent pixel has the lowest luminance. When it is determined that a candidate for the boundary pixel BP is not plural (S535: NO), the CPU 210 proceeds to S555. When it is determined that a candidate for the boundary pixel BP is plural (S535: YES), the CPU 210 determines whether the notice row is a first pixel row, i.e., a pixel row located at an upstream end (a left end in FIG. 13) with respect to the X direction, in S540.

When it is determined that the notice row is a first pixel row (S540: YES), the CPU 210 specifies, as the boundary pixel BP, a pixel closest to the center in the Y direction of the plurality of candidates, in S545. When it is determined that the notice row is not a first pixel row (S540: NO), the CPU 210 specifies, as the boundary pixel BP, a pixel closest to the boundary pixel BP on the previous notice row, for example, a pixel row adjacent to the left side in the third embodiment, in S550.

In S555, the CPU 210 determines whether all the pixel rows in the notice partial image have been processed as the notice row. When it is determined that all the pixel rows have been processed (S555: YES), the CPU 210 proceeds to S560. When it is determined that there is a pixel row not processed yet (S555: NO), the CPU 210 returns to S510.

In S560, the CPU 210 divides the notice partial image, based on the boundary pixel BP of each pixel row, thereby determining the first area PA1 and the second area PA2, like in S480 of FIG. 10. Specifically, the CPU 210 allots pixels, which are located downstream (upper side in FIG. 13) of the boundary pixel BP with respect to the Y direction, to the first partial printing, and allows the boundary pixel BP and pixels, which are located upstream (lower side in FIG. 13) of the boundary pixel BP with respect to the Y direction, to the second partial printing. As a result, an area upstream of a boundary line BLc, which is obtained by connecting the boundary pixels BP on the respective pixel rows, with respect to the Y direction is determined as the first area PA1, and an area (including pixels on the boundary line BLc) downstream of the boundary line BLc with respect to the Y direction is determined as the second area PA2. When the first area PA1 and the second area PA2 are determined, the division processing is over.

More specifically, with reference to FIG. 13, since the pixel rows CL5 and CL8 in FIG. 13, for example, are located in a white background area Bac, all pixels on the pixel rows CL5 and CL8 in FIG. 13 have the same luminance V. For this reason, in a case in which the notice row is the pixel rows CL5 and CL8, there is a plurality of pixels having the greatest luminance V (YES in S525). Since there is no pixel, which is adjacent to a pixel having luminance lower than a target candidate, of the plurality of candidates, there is still a plurality of candidates for the boundary pixel BP even at the point of time of S535 (YES in S535). Therefore, in a case in which the notice row is the pixel rows CL5 and CL8, pixels of which positions in the Y direction are the same as the boundary pixel BP on the previous pixel row (pixel row adjacent to the left side) are specified as the boundary pixels BP5 and BP 8 (S550).

Also, for example, the plurality of pixels on the pixel row CL6 in FIG. 13 includes pixels on the ruled line RL of the table Obc in the X direction, and pixels on a portion different from the rule line RL. A pixel, which is on the ruled line RL of the table Obc, of the plurality of pixels on the pixel row CL6 has the lowest luminance V, and a pixel on the portion different from the ruled line RL has the greatest luminance V. For this reason, there is a plurality of pixels having the greatest luminance V (YES in S525). The pixels, of which adjacent pixels have the lowest luminance, of the plurality of candidates are a plurality of pixels adjacent to an upper or lower side of the ruled line RL. Therefore, at the point of time of S535, the candidate for the boundary pixel BP is the plurality of pixels adjacent to an upper or lower side of the ruled line RL (YES in S535). Therefore, in a case in which the notice row is the pixel row CL6, a pixel that is adjacent to the ruled line RL and is located in a position in the Y direction closest to the boundary pixel BP on the previous pixel row (pixel row adjacent to the left side) is specified as the boundary pixel BP6 (S550).

Also, for example, since the pixel row CL7 in FIG. 13 is positioned on the ruled line RL of the table Obc in the Y direction, all pixels on the pixel row CL7 in FIG. 13 have the same luminance V. For this reason, in a case in which the notice row is the pixel row CL7, there is a plurality of pixels having the greatest luminance V (YES in S525). Since there is no pixel, which is adjacent to a pixel having luminance lower than a target candidate, of the plurality of candidates, there is still a plurality of candidates for the boundary pixel BP even at the point of time of S535 (YES in S535). Therefore, in a case in which the notice row is the pixel row CL7, a pixel of which a position in the Y direction is the same as the boundary pixel BP on the previous pixel row (pixel row adjacent to the left side) is specified as the boundary pixel BP7 (S550).

As can be seen from above, in the example of FIG. 13, the boundary line BLc in the partial image PI3*c* is a line formed along an upper edge of one ruled line RL of the table Obc in the X direction.

As can be seen from the descriptions above, according to the third embodiment, the CPU 210 determines the first area PA1 and the second area PA2 so that at least a part of the boundary (for example, the boundary line BLc in FIG. 13) between the first area PA1 and the second area PA2 is to be formed along an edge (for example, an edge of the ruled line RL in the X direction) in the partial image (for example, the partial image PI3*c* in FIG. 13). When the boundary between the first area PA1 and the second area PA2 is formed along the edge, it is considered that the boundary is less noticeable, as compared to a case in which the boundary is located at a portion different from an edge of the solid area. Therefore, according to the third embodiment, it is possible to efficiently reduce the case where the boundary between the first area PA1 and the second area PA2 is noticeable.

D. Modified Embodiments (1) In the object specifying processing (FIG. 8) of the image division processing of the first embodiment, the plurality of objects in the notice partial image is specified using the values of pixels in the notice partial image data that is the RGB image data. Instead of this configuration, for example, in a case in which the image data to be used is data describing an image by using a predetermined page description language such as a PDF file, the image data includes a drawing command for each object, for example. In this case, the CPU 210 may specify, as the first object, an object (for example, a character) to be drawn based on a first drawing command (for example, a drawing command for drawing a character), and specify, as the second object, an object (for example, a photograph) to be drawn based on a second drawing command (for example, a drawing command for drawing a photograph). By performing the rasterization according to the drawing commands, values of respective pixels in an image to be expressed by the image data are determined. Therefore, it can be said that the drawing commands are information for determining values of pixels.

(2) For example, as described above, when the image data including the drawing commands is used, the first object to be drawn based on the first drawing command and the second object to be drawn based on the second drawing command may overlap each other. For example, the second object is overlapped over the first object, so that a part of the first object is hidden by the second object. In this case, the first object and the second object may not be separated by the white background area BA. Also in this case, the CPU 210 may determine, as the first area PA1, an area (i.e., an area of the first object not hidden by the second object), which includes the first object and does not include the second object, and may determine, as the second area PA2, an area that includes the second object and does not include the first object. In this case, since the boundary between the first area PA1 and the second area PA2 is located at a boundary between the first object and the second object overlapped each other, it is possible to avoid the boundary between the first area PA1 and the second area PA2 from being noticeable.

(3) In the first embodiment, the used amount IUo of ink is used as an index value relating to an amount of ink to be used when printing an object area. However, other index values may also be used. As the other index values, for example, the number of dots to be formed upon the printing or a ratio of the number of dots to a total number of pixels may be used. Also, a size of an object area may be used.

(4) In the first embodiment, the first area PA1 and the second area PA2 are determined so that the amount of ink to be used for printing of the second area PA2 is to be larger than the amount of ink to be used for printing of the first area PAL However, the present disclosure is not limited thereto. For example, the first area PA1 and the second area PA2 may be determined so that the amount of ink to be used for printing of the first area PA1 is to be larger than the amount of ink to be used for printing of the second area PA2. Also, the first area PA1 and the second area PA2 may be determined so that the amounts of ink to be used for printing of the two areas PA1 and PA2 are to be the same.

(5) In the image division processing (FIG. 10) of the second and third embodiments, the boundary pixel BP is specified using the luminance V of each pixel on the notice row (S420 to S440 in FIG. 10). Instead of this configuration, for example, the boundary pixel BP may be specified using the density of each pixel on the notice row. In this case, the weighted density may be calculated using weighs that are smallest at the center in the Y direction and are greatest at both ends in the Y direction, and a pixel of which a weighted density is smallest may be specified as the boundary pixel BP.

(6) In the second and third embodiments, the boundary pixel BP is determined for each pixel row by using the luminance V of each pixel, so that the first area PA1 and the second area PA2 are determined. Instead of this configuration, the luminance V may be calculated for each block (for example, 3 pixels in height×3 pixels in width) including a plurality of pixels and a boundary block may be determined for each block row by using the luminance V, so that the first area PA1 and the second area PA2 may be determined. That is, a size of a unit area for which the processing is executed may be a size of one pixel or a size of multiple pixels.

(7) The image division processing of the first to third embodiments is only exemplary, and the present disclosure is not limited thereto. The first area PA1 and the second area PA2 may be determined by an algorithm in which the drawing command or the pixel value information such as a pixel value included in the image data is used. For example, as shown in FIG. 13 of the third embodiment, in the case in which the partial image PI3*c* including the table Obc is divided, the CPU 210 may detect an edge to specify the ruled lines RL and a plurality of rectangular areas CA surrounded by the ruled lines RL. An area consisting of some rectangular areas CA may be determined as the first area PA1, and an area consisting of the ruled lines RL and the other rectangular areas CA may be determined as the second area PA2. Also in this case, the boundary between the first area PA1 and the second area PA2 is located along the edges between the ruled line RL and some rectangular areas CA surrounded by the ruled lines RL, it is possible to avoid the boundary between the first area PA1 and the second area PA2 from being noticeable.

(8) In the first embodiment, in a case in which the printer 200 receives the dot data from the terminal apparatus 300 and the printing is executed using the dot data, the first area PA1 and the second area PA2 may be determined using the dot data, for example. For example, the CPU 210 executes labeling processing for pixels indicative of the formation of dots by using the partial dot data indicative of the notice partial image, thereby specifying a plurality of dot areas consisting of continuous dots. The CPU 210 may classify the plurality of dot areas into an area belonging to the first area PA1 and an area belonging to the second area PA2, based on sizes (number of pixels) of each dot area, thereby determining the first area PA1 and the second area PA2.

(9) In the respective embodiments, the specific condition indicating whether the delay in ink supply may occur is determined using the head temperature Th, the cumulative-used amount TA of ink and the used amount IUo of ink. However, the present disclosure is not limited thereto. For example, the specific condition may be determined by using only the head temperature Th and the used amount IUo of ink. In this case, for example, in the determination threshold value table TT of FIG. 7, only three determination threshold values JT corresponding to three types of head temperatures Th (low, medium and high) may be defined. Also, the specific condition may be determined by using only the cumulative-used amount TA of ink and the used amount IUo of ink. In this case, in the determination threshold value table TT, only three determination threshold values JT corresponding to three types of cumulative-used amounts TA of ink (small, medium and large) may be defined.

(10) In the printing mechanism 100 of the respective embodiments, the sub-scanning in which the conveyor unit 140 conveys the sheet M to relatively move the sheet M relative to the printing head 110 in the conveying direction is performed. Instead of this configuration, the sub-scanning may be performed by moving the printing head 110 relative to the fixed sheet M in an opposite direction to the conveying direction.

(11) In the special partial printing of the respective embodiments, the notice partial image is printed by the two partial printings that are executed without conveying the sheet M. Instead of this configuration, in the special partial printing, the notice partial image may be printed by three or more partial printings that are executed without conveying the sheet M. For example, when the notice partial image is printed by the three partial printings, the notice partial image is divided into a first area, a second area and a third area by using the notice partial image data. Then, the first area, the second area and the third area may be respectively printed by single partial printing.

(12) As the printing medium, instead of the sheet M, other media such as an OHP film, a CD-ROM, and a DVD-ROM may be adopted.

(13) In the respective embodiments, the device configured to execute the image processing of FIG. 5 is the CPU 210 of the printer 200. Instead of this configuration, the device configured to execute the image processing of FIG. 5 may be other device, for example, the terminal apparatus 300. In this case, for example, the terminal apparatus 300 operates as a printer driver by executing a driver program, and executes the image processing of FIG. 5 so as to cause the printer 200, which is the printing execution unit, to execute the printing as a part of functions of the printer driver. In this case, the terminal apparatus 300 implements the conveyance of the sheet M in S105 of FIG. 5 by transmitting a conveying command to the printer 200, for example. Also, in this case, the terminal apparatus 300 acquires the head temperature Th and the cumulative-used amount TA of ink from the printer 200, in S210 and S220 of FIG. 6. Also, the terminal apparatus 300 implements the partial printing of S130, S145 and S150 in FIG. 5 by transmitting a partial printing command including the dot data to the printer 200, for example.

As can be seen from the descriptions above, in the respective embodiments, the printing mechanism 100 is an example of the printing execution unit. Like this modified embodiment, when the terminal apparatus 300 executes the image processing, the entire printer 200 configured to execute the printing is an example of the printing execution unit.

(14) The device configured to execute the image processing of FIG. 5 may be a server configured to acquire image data from the printer 200 or the terminal apparatus 300, to generate the conveying command or the partial printing command by using the image data, and to transmit the command to the printer 200. The server may be a plurality of calculators capable of performing communication each other via the network.

(15) In the respective embodiments, some of the configuration implemented by hardware may be replaced with software, and some or all of the configuration implemented by software may be replaced with hardware. For example, some of the image processing shown in FIG. 5 may be implemented by a dedicated hardware circuit (for example, ASIC) configured to operate in response to an instruction from the CPU 210.

The present disclosure has been described with reference to the embodiments and the modified embodiments. The embodiments of the present disclosure are provided so as to easily understand the present disclosure, not to limit the present disclosure. The present disclosure may be changed and improved without departing from the gist thereof, and the present disclosure includes equivalents thereof.

In the above embodiments, the conveyer unit 140 conveying the paper M with the pair of the upstream roller and the pair of the downstream roller is used. A conveyer unit is not limited thereto. For example, a configuration in which the paper M is absorbed on a peripheral surface of an endless belt and the endless belt on which the paper M is disposed is conveyed may be adopted. The endless belt may absorb the paper M with electrostatic chuck or air drawn in through a hole formed on the endless belt. The conveyer may be a stage supporting the paper M and moving in a conveying direction along with the paper M.

An example in which the present invention is applied to the printer performing printing on the paper M by ejecting ink from the nozzle is explained as above. The paper M is not limited to such cut form. For example, as a substitute of the printer for the cut form, the present invention may be applied to a printer for a long paper including a roll paper. The present invention may be applied to a printer performing printing by ejecting ink to a print media other than the recording paper, the print media including a T-shirt, a sheet for an outdoor advertising, a case for a mobile terminal including a smart phone, a cardboard, and a resin material. The present invention may be applied to a printer ejecting liquid other than ink, for example, liquefied resin, and liquefied metal.

What is claimed is:

1. A control device for a printing execution device including:

a printing head that has a plurality of nozzles configured to eject ink;

an ink supply unit that is configured to supply the ink to the printing head;

a main scanning device that is configured to execute a main scanning of moving the printing head relative to a printing medium in a main scanning direction; and a sub-scanning device that is configured to execute a sub-scanning of moving the printing medium relative to the printing head in a sub-scanning direction intersecting with the main scanning direction, the control device being configured to:

acquire image data including pixel value information, which is at least one of a pixel value and information for determining the pixel value; and cause the printing execution device to perform printing by performing a partial printing and causing the sub-scanning device to perform the sub-scanning multiple times, the partial printing being to cause the printing head to eject the ink to form dots on the printing medium while causing the main scanning device to execute the main scanning with the image data, wherein the control device is configured to control the main scanning device and the sub-scanning device to print partial images by single partial printing in a first case where a specific condition is not satisfied, the specific condition indicating that ink supply from the ink supply unit to the printing head may be delayed in the partial printing and determined for each of the partial images which corresponds to the partial printing and which is part of an image based on the image data, control the main scanning device and the sub-scanning device to print the partial images by a plurality of partial printings including a first partial printing and a second partial printing in a second case where the specific condition is satisfied, and determine a first area of the partial image to be printed by the first partial printing and a second area of the partial image to be printed by the second partial printing by using the pixel value information included in the image data, in the second case.

2. The control device according to claim 1, wherein the control device is configured to determine the first area and the second area so that the first area and the second area are respectively continuous to a third area in which no dot is formed in any of the first partial printing and the second partial printing, and are not respectively continuous to each other.

3. The control device according to claim 1, wherein the control device is configured to:

specify a plurality of objects in the partial image by using the pixel value information included in the image data; and determine an area including a first object of the plurality of objects as the first area, and, an area including a second object of the plurality of objects as the second area.

4. The control device according to one of claim 1, wherein the control device is configured to:

calculate an index value which corresponds to an amount of the ink to be used when printing an image in an area, for each of a plurality of areas in the partial image by using the pixel value information included in the image data; and classify the plurality of areas into an area belonging to the first area and an area belonging to the second area by using the index values to determine the first area and the second area.

5. The control device according to claim 4, wherein the control device is configured to:

execute the second partial printing after the first partial printing; and determine the first area and the second area by using the index values so that an amount of the ink to be used for printing of the second area is to be larger than an amount of the ink to be used for printing of the first area.

6. The control device according to claim 5, wherein the control device is configured to determine each of the plurality of areas in the partial image as any one of the first area and the second area by using the index values such that an amount of the ink to be used for printing of the second area is to be larger than an amount of the ink to be used for printing of the first area and is to be smaller than a specific upper limit amount.

7. The control device according to claim 1, wherein when the partial image includes a first part, a second part having a density lower than that of the first part and located in a further specific direction than the first part, and a third part having a density higher than that of the second part and located in the further specific direction than the second part, the control device determines an area including the first part as the first area, and an area including the third part as the second area.

8. The control device according to claim 7, wherein the control is configured to:

calculate weighted index values of a plurality of areas aligned in the specific direction by using index values indicative of densities of the plurality of areas and weights corresponding to positions in the specific direction;

specify an area, of which a density indicated by the weighted index value is lowest, of the plurality of areas, as the second part; and determine the first area and the second area by using a specifying result of the second part, and wherein the weights are set such that the weighted index value of an area having a specific density and located at a central portion in the specific direction indicates a density lower than the weighted index values of areas having the specific density and located at both end portions in the specific direction.

9. The control device according to claim 8, wherein the index value is a luminance, and wherein the weight corresponding to the central portion in the specific direction is greater than the weights corresponding to both the end portions in the specific direction.

10. The control device according to claim 1, wherein the control device is configured to determine the first area and the second area so that at least a part of a boundary between the first area and the second area is to be formed along an edge in the partial image.

11. A printer comprising:

a printing head that has a plurality of nozzles configured to eject ink;

an ink supply unit that is configured to supply the ink to the printing head;

a main scanning device that is configured to execute a main scanning of moving the printing head relative to a printing medium in a main scanning direction;

a sub-scanning device that is configured to execute a sub-scanning of moving the printing medium relative to the printing head in a sub-scanning direction intersecting with the main scanning direction; and the control device according to claim 1.

12. A computer readable medium storing a program for a printing execution device including:

a printing head that has a plurality of nozzles configured to eject ink;

an ink supply unit that is configured to supply the ink to the printing head;

a main scanning device that is configured to execute a main scanning of moving the printing head relative to a printing medium in a main scanning direction; and a sub-scanning device that is configured to execute a sub-scanning of moving the printing medium relative to the printing head in a sub-scanning direction intersecting with the main scanning direction, wherein the program causes a computer to implement:

an acquisition function of acquiring image data including pixel value information, which is at least one of a pixel value and information for determining the pixel value; and a printing control function of causing the printing execution device to perform printing by performing a partial printing and causing the sub-scanning device to perform the sub-scanning multiple times, the partial printing being to cause the printing head to eject the ink to form dots on the printing medium while causing the main scanning device to execute the main scanning with the image data, wherein the printing control function is printing partial images by single partial printing in a first case where a specific condition is not satisfied, the specific condition indicating that ink supply from the ink supply unit to the printing head may be delayed in the partial printing and determined for each of the partial images which corresponds to the partial printing and which is part of an image based on the image data, printing the partial images by a plurality of partial printings including a first partial printing and a second partial printing in a second case where the specific condition is satisfied, and determining a first area of the partial image to be printed by the first partial printing and a second area of the partial image to be printed by the second partial printing by using the pixel value information included in the image data, in the second case.

* * * * *